US009352448B2

(12) United States Patent
Adia et al.

(10) Patent No.: US 9,352,448 B2
(45) Date of Patent: May 31, 2016

(54) SUPERHARD STRUCTURE AND METHOD OF MAKING SAME

(75) Inventors: Moosa Mahomed Adia, Springs (ZA); Geoffrey John Davies, Springs (ZA); David Christian Bowes, Springs (ZA)

(73) Assignee: ELEMENT SIX ABRASIVES S.A., Luxembourg (LU)

( * ) Notice: Subject to any disclaimer, the term of this patent is extended or adjusted under 35 U.S.C. 154(b) by 147 days.

(21) Appl. No.: 13/997,787

(22) PCT Filed: Dec. 20, 2011

(86) PCT No.: PCT/EP2011/073477
§ 371 (c)(1),
(2), (4) Date: Sep. 2, 2013

(87) PCT Pub. No.: WO2012/089567
PCT Pub. Date: Jul. 5, 2012

(65) Prior Publication Data

US 2013/0333301 A1 Dec. 19, 2013

Related U.S. Application Data

(60) Provisional application No. 61/428,942, filed on Dec. 31, 2010.

(30) Foreign Application Priority Data

Dec. 31, 2010 (GB) ..... 1022130.7

(51) Int. Cl.
*B24D 3/06* (2006.01)
*B22F 7/06* (2006.01)
*C22C 26/00* (2006.01)

(52) U.S. Cl.
CPC . *B24D 3/06* (2013.01); *B22F 7/062* (2013.01); *C22C 26/00* (2013.01)

(58) Field of Classification Search
CPC ..... B24D 3/06; B24D 3/26; B24D 3/04
See application file for complete search history.

(56) References Cited

U.S. PATENT DOCUMENTS

| | | | | |
|---|---|---|---|---|
| 4,729,440 | A | 3/1988 | Hall | |
| 6,398,815 | B1 | 6/2002 | Pope et al. | |
| 2005/0133277 | A1 | 6/2005 | Dixon | |
| 2007/0102199 | A1 | 5/2007 | Smith | |
| 2007/0187155 | A1 | 8/2007 | Middlemiss | |
| 2011/0120782 | A1 * | 5/2011 | Cooley et al. | 175/432 |

FOREIGN PATENT DOCUMENTS

| | | | |
|---|---|---|---|
| EP | 2108630 | A1 | 10/2009 |
| GB | 2463975 | A | 4/2010 |
| WO | 2004111284 | A2 | 12/2004 |

OTHER PUBLICATIONS

International Search Report for PCT/EP2011/073473 dated Apr. 24, 2012.
International Search Report for PCT/EP2011/073477 dated Apr. 16, 2012.
Search Report for GB1022127.3 dated Apr. 21, 2011.
Search Report for GB1121921.9 dated Apr. 19, 2012.
Search Report for GB1121925.0 dated Apr. 19, 2012.
Search Report for GB1022130.7 dated Apr. 21, 2011.

* cited by examiner

*Primary Examiner* — Pegah Parvini
(74) *Attorney, Agent, or Firm* — Bryan Cave LLP

(57) ABSTRACT

A superhard structure comprises a body of polycrystalline superhard material comprising a first region and a second region. The second region is adjacent an exposed surface of the superhard structure and comprises a diamond material or cubic boron nitride with a density greater than 3.4×103 kilograms per cubic meter when the second region comprises diamond material. The material(s) forming the first and second regions have a difference in coefficient of thermal expansion, the first and second regions being arranged such that this difference induces compression in the second region adjacent the exposed surface. The first/a further region has the highest coefficient of thermal expansion of the polycrystalline body and is separated in part from a peripheral free surface of the body by the second region or one or more further regions formed of a material(s) of a lower coefficient of thermal expansion. The regions comprise a plurality of grains of polycrystalline superhard material. The second region is peripherally discontinuous with a gap therein through which a portion of the region formed of the material of highest coefficient of thermal expansion extends to the free surface of the superhard structure. There is also disclosed a method for making such a structure.

14 Claims, 24 Drawing Sheets

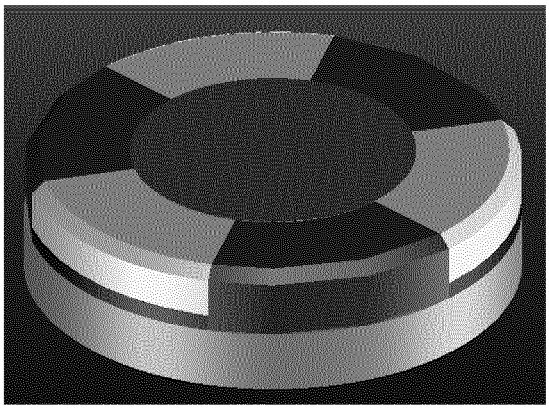
FIGURE 14
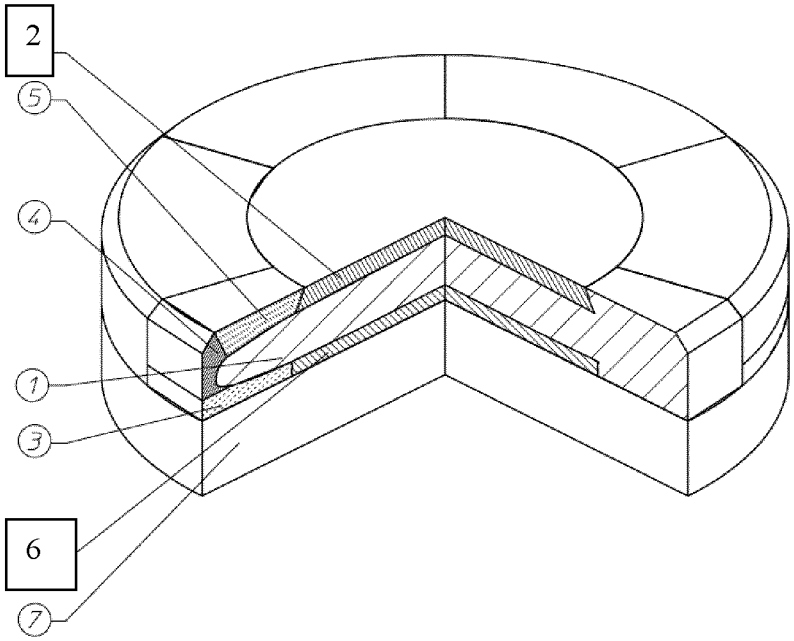

AXIAL STRESSES

EXAMPLE 3

AXIAL STRESSES

EXAMPLE 3

RADIAL STRESSES

EXAMPLE 3

HOOP STRESSES

EXAMPLE 4

SUPERHARD STRUCTURE AND METHOD OF MAKING SAME

FIELD

This disclosure relates to a superhard structure comprising a body of polycrystalline material, a method of making a superhard structure, and to a wear element comprising a polycrystalline superhard structure.

BACKGROUND

Polycrystalline diamond (PCD) materials may be made by subjecting a mass of diamond particles of chosen average grain size and size distribution to high pressures and high temperatures while in contact with a pre-existing hard metal substrate. Typical pressures used in this process are in the range of around 4 to 7 GPa but higher pressures up to 10 GPa or more are also practically accessible. Temperatures employed are above the melting point at such pressures of the transition metal binder of the hard metal substrate. For the common situation where tungsten carbide/cobalt substrates are used, temperatures above 1395° C. suffice to melt the metal in the binder, for example cobalt, which infiltrates the mass of diamond particles enabling sintering of the diamond particles to take place. The resultant PCD material may be considered as a continuous network of bonded grains of diamond with an interpenetrating network of binder, for example a cobalt based metal alloy. The so-formed PCD material which forms a PCD table bonded to the substrate, is then quenched by dropping the pressure and temperature to room conditions. During the temperature quench, the metal in the binder solidifies and bonds the PCD table to the substrate. At these conditions, the PCD table and substrate may be considered as being in thermoelastic equilibrium with one another.

Typically, but not exclusively, cutting elements or cutters for boring, drilling or mining applications consist of a layer of polycrystalline diamond material (PCD) in the form of a diamond table bonded to a larger substrate or body often made from tungsten carbide/cobalt cemented hard metal. Such cutters with their attendant carbide substrates are traditionally and commonly made as right cylinders with the polycrystalline diamond layer or table typically ranging in thickness from about 0.5 mm to 5.0 mm but more often in the range 1.5 mm to 2.5 mm. The hard metal substrates are typically from 8 mm to 16 mm long. The commonly used diameters of the right cylindrical cutters are in the range 8 mm to 20 mm.

Other PCD constructions such as general domed and pick shaped elements are also used in various applications, for example drilling, mining and road surfacing applications. Often, the PCD material forms an outer layer on such elements with a metal carbide being used as a substrate bonded thereto. Again, the substrate is usually the largest part of such structures.

Commonly, the types of drill bit where such cutters are employed are termed drag bits. In this type of drill bit, several PCD cutters are arranged in the drill bit body so that a portion of the top peripheral edge of each PCD table bears on the rock formations. Due to the rotation of the bit, the top peripheral edge of each PCD table of each cutter experiences loading and subsequent abrasive wear processes resulting in a progressive removal of a limited amount of the PCD material. The worn area on the PCD table is referred to as the wear scar.

The performance of PCD cutters during drilling operations is determined, to a large extent, by the initiation and propagation of cracks in the PCD table. Cracks which propagate towards and intersect the free surface of a cutter may result in spalling of the cutter where a large volume of PCD breaks off from the PCD table. The result of this phenomenon may reduce the useful life of the drill bit and may lead to catastrophic failure of the cutter.

It is desirable that any cracks that form should be arrested, inhibited or deflected from propagating through the body of the PCD table to a free surface, thereby prolonging the useful life of the cutter.

International patent application WO 2004/111284 discloses a composite material comprising a plurality of cores, each core comprising a single granule of PCD, the cores being dispersed in a matrix which coats the individual granules, and a suitable binder. The matrix is formed of a PCD material of a grade different to that of the cores.

Other known solutions concern, directly or indirectly, limited ways of dealing with crack behaviour for example by means of specific layer designs.

There is a need for general solutions for a polycrystalline superhard material having favourable residual stress distributions which can ameliorate undesirable crack propagation and so lead to the reduction of spalling.

SUMMARY

Viewed from a first aspect there is provided a superhard structure comprising:

a body of polycrystalline superhard material comprising:

a first region; and a second region, the second region being adjacent an exposed surface of the superhard structure, the second region comprising a diamond material or cubic boron nitride, the density of the second region being greater than $3.4\times10^3$ kilograms per cubic meter when the second region comprises diamond material;

wherein the material or materials forming the first and second regions have a difference in coefficient of thermal expansion, the first and second regions being arranged such that the difference between the coefficients of thermal expansion induces compression in the second region adjacent the exposed surface; and wherein the first region or a further region has the highest coefficient of thermal expansion of the polycrystalline body and is separated in part from a peripheral free surface of the body of polycrystalline superhard material by the second region or one or more further regions formed of a material or materials of a lower coefficient of thermal expansion, wherein the regions comprise a plurality of grains of polycrystalline superhard material; and wherein the second region is peripherally discontinuous with a gap therein through which a portion of the region formed of the material of highest coefficient of thermal expansion extends to the free surface of the superhard structure.

Viewed from a second aspect there is provided a process for making a polycrystalline superhard structure comprising:

a) forming a first region of polycrystalline material;

b) forming a second region of polycrystalline material adjacent the first region and as an exposed surface, the second region being peripherally discontinuous, the second region comprising polycrystalline diamond or cubic boron nitride; wherein the material(s) forming the first and second regions have one or more differences in physical properties;

c) subjecting the first and second regions to a pressure greater than 4 GPa and a temperature greater than 1200° C. for a predetermined time; and d) reducing the pressure and temperature to ambient conditions such that the one or more differences between the physical properties induces compression in the second region adjacent the exposed surface; wherein the first region or a further region has the highest coefficient of thermal expansion of the polycrystalline body and is separated in part from a peripheral free surface of the body of polycrystalline superhard material by the second region or one or more further regions formed of a material or materials of a lower coefficient of thermal expansion and extends through a gap in the second region to the free surface of the superhard structure; and wherein the regions comprise a plurality of grains of polycrystalline superhard material.

Viewed from a third aspect there is provided a drill bit or a cutter or a component therefor comprising the superhard structure(s) described herein.

BRIEF DESCRIPTION OF THE DRAWINGS

FIG. 14 is a schematic diagram with a cutaway section to expose the internal arrangement of various regions of a further embodiment;

DETAILED DESCRIPTION

Figure 1:
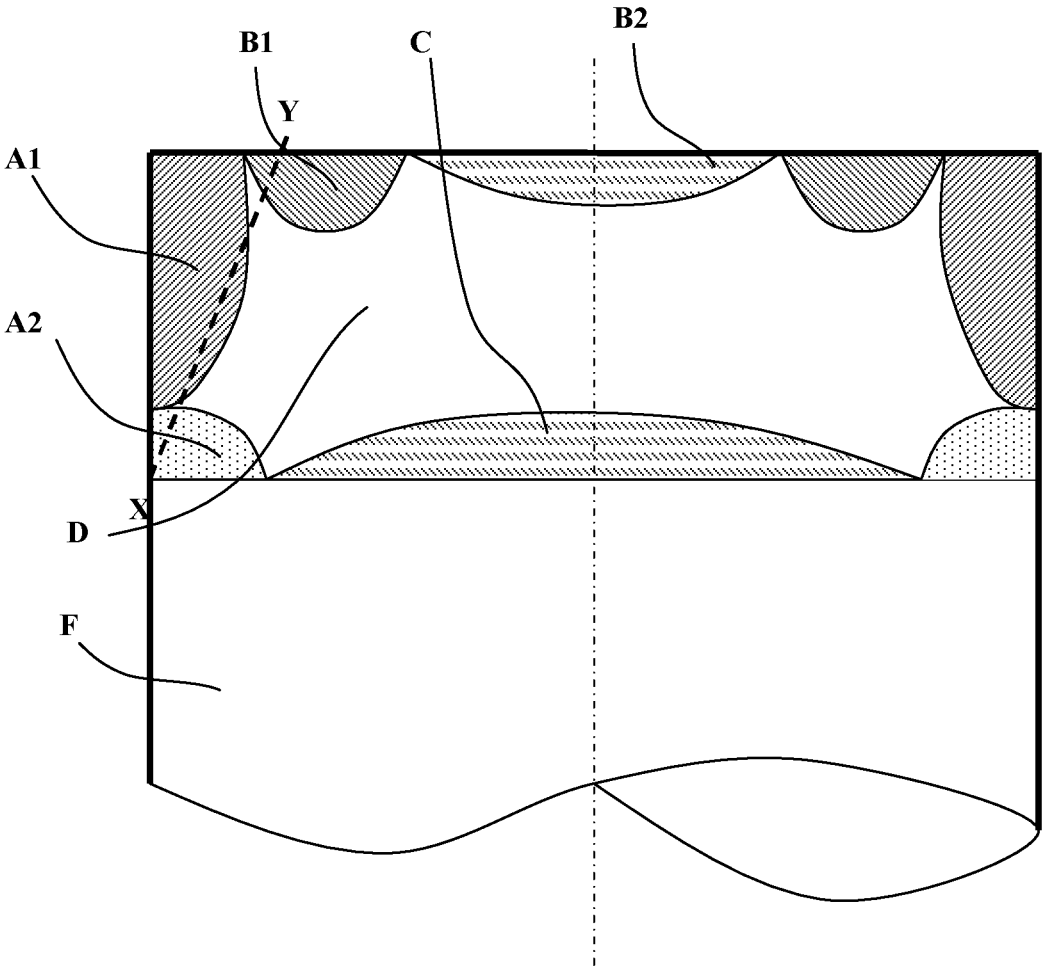
FIG. 1 is a schematic cross sectional drawing of a planar interface PCD cutter in which the shaded areas depict regions in which cracks preferentially propagate.

As used herein, a "superhard material" is a material having a Vickers hardness of at least about 25 GPa. Diamond and cubic boron nitride (cBN) material are examples of superhard materials." Diamond is the hardest known material with cubic boron nitride (cBN) considered to be second in this regard. Both materials are termed to be superhard materials. Their measured hardnesses are significantly greater than nearly all other materials. Hardness numbers are figures of merit, in that they are highly dependent upon the method employed to measure them. Using Knoop indenter hardness measurement techniques at 298° K, diamond has been measured to have a hardness of 9000 kg/mm$^2$ and cBN 4500 kg/mm$^2$ both with 500 g loading. PCD materials typically have a hardness falling in the range 4000 to 5000 kg/mm$^2$ when measured using similar techniques with either Vickers or Knoop indenters. Other hard materials such as boron carbide, silicon carbide, tungsten carbide and titanium carbide have been similarly measured to have hardnesses of 2250, 3980, 2190 and 2190 kg/mm$^2$ respectively. For the purposes discussed herein, materials with measured hardnesses greater than around 4000 kg/mm$^2$ are considered to be superhard materials.

Residual stresses locked into a cutter comprising the superhard material after the fabrication process thereof at HPHT conditions are considered to be particularly pertinent to crack initiation and propagation during application of the cutter. Very significant residual stresses are set up on completion of the quench to room temperature and pressure conditions due to the very different moduli of elasticity and coefficients of thermal expansion between the superhard material, for example a PCD material, and the substrate. Although the table of superhard material is now in an overall compressive state of stress, the bending effect caused by bonding the table to the one side of the substrate results in localised tensile stress in critical regions of the table.

From laboratory and field trials of PCD cutters, it has been observed that cracks in the PCD material initiate and propagate in certain critical regions as the cutter wears. In particular, cracks tend to initiate on the surface of the wear scar or just behind the wear scar. After the cracks have initiated, they propagate into the body of the PCD material, either parallel to the top of the PCD table, or they veer towards the top of the PCD table or towards the PCD-carbide substrate interface. Cracks which veer towards a surface of the PCD material are likely to cause chipping or spalling of the PCD table or loss of large sections of PCD material which can reduce cutter life and the efficiency of cutting. It has been observed that the life of a cutter is prolonged if propagating cracks are arrested, deflected or directed towards the PCD-carbide interface or generally away from the surfaces of the PCD material.

There is described herein the alteration of the stress distribution in regions, in which cracks are believed to the propagate to assist in the inhibition of further propagation of cracks or to deflect them away from those critical regions in which they preferentially propagate, or to restrict the cracks to preferred volumes or regions for crack propagation which are less detrimental to the cutter life. Methods of manipulating the stresses in the PCD material so as to induce compression or reduce tension in the critical regions are described. Alternatively and in addition, tensile maximum stresses in the critical regions may be displaced and moved away from the free surfaces. The position of the original critical region may now be occupied by material in a compressed state. By placing polycrystalline material such as a PCD material having increased compression or lowered tension in the path of the cracks may have the effect of channelling or deflecting cracks into the regions of higher tension. Such channelling or deflection preferably directs the cracks away from the free surfaces of the superhard material, for example the PCD material.

To induce compression in appropriate positions within the PCD table of a cutter, during the fabrication process, different materials having differing properties are adjoined. This includes properties such as coefficient of thermal expansion and/or modulus of elasticity or any other physical property which, after the fabrication process, would result in the one material inducing a compression in the adjoining other material, which itself will go into a state of tension or reduced compression.

If two materials differing in coefficient of thermal expansion are joined during a high temperature fabrication process then, on cooling, the material having the higher coefficient of thermal expansion would try to contract more than the other material. The material having the high coefficient of thermal expansion is then inhibited from contracting by the material having the lower coefficient of thermal expansion and, as a result, a compressive stress is induced in the latter material.

Another way of inducing compression in a material is by adjoining materials of differing elastic modulus during a high pressure fabrication process. On release of pressure, the material with the higher modulus of elasticity will induce a compression on the material with the lower modulus of elasticity and itself will undergo an increased tension.

Cutters containing, for example, a body of PCD material, may be fabricated using high temperature combined with high pressure, in which these approaches for inducing compression are utilised.

It has been observed that some PCD material types differ significantly in both coefficient of thermal expansion and modulus of elasticity. In these materials, when the coefficient of thermal expansion is low, the elastic modulus is high. Thus when different materials from this group are exploited, the quench from high temperature and high pressure during formation of the material causes opposing stress induction effects. However, the stress change effects brought about by the coefficient of thermal expansion differences dominate.

It has also been observed that other PCD material types, although having significantly different coefficients of thermal expansion, can have only small and relatively insignificant differences in the moduli of elasticity. When such PCD materials are used, the effect of the modulus of elasticity differences may largely be ignored.

To aid further discussion, the residual stresses in the PCD layer of cylindrical cutters are hereafter resolved using cylindrical coordinates into axial, radial and hoop components, that is, along the axis of the cutter, along the radius thereof and tangential to the radius, respectively.

In typical traditional cutters, the critical regions within which cracks have a preference to initiate and/or propagate are indicated schematically in FIG. 1. These critical regions may differ in position, magnitude and direction of the tensile stress, and may be defined as follows:

1. The region in which the cracks initiate, namely, the surface region in and around the wear scar, shown as regions A1 and A2 in FIG. 1. A typical position of the wear scar is indicated as the dotted line X-Y in FIG. 1. Region A1 indicates the region of crack initiation during the early stages of cutter wear, whereas region A2 refers to the later stages of wear. Region A1 is associated with a tensile hoop stress and A2 with a tensile axial stress.
2. The region towards the top surface of the PCD material into which cracks propagate and cause premature spalling of the cutter, shown as region B1 and B2 in FIG. 1. As with regions A1 and A2, regions B1 and B2 are associated with the early and later stages of wear, respectively. Regions B1 and B2 are associated with tensile radial and axial stresses.
3. The region towards the centre of the PCD material immediately above the carbide substrate into which some of the cracks propagate after the cutter has been worn substantially, shown as region C in FIG. 1. Cracks propagating into this region are less likely to be harmful as they do not break out to a free surface of the PCD material. Region C is associated with a small tensile axial stress.
4. Region D in FIG. 1 represents the bulk volume of the PCD material outside of these critical regions but wherein there is a significantly lower tendency for cracks to propagate. In this region, hoop and radial stresses are generally compressive and axial stresses move from mildly tensile to compressive in a radial direction.

The critical regions described above identify the positions in the PCD table where volumes of different PCD materials may be placed in order to alter the residual stress distribution which arises from the general cutter structure and manufacturing process thereof. The desired alteration in the residual stress distribution involves the induction of compression or reduced tension in the critical regions. Alternatively, the critical regions with their attendant tensile stress maxima may be displaced from the free surface of the PCD table to the inside volume of the PCD table where they are less harmful. These alterations to the stress distribution serve to arrest or deflect or direct cracks to less critical regions away from free surfaces and towards the bulk volume of the PCD table and the carbide interface. In turn, the occurrence of cracks propagating to the free surfaces which would previously cause spalling of the PCD table is diminished and this may lead to a desirable increase in cutter life.

This identification of the critical regions and the placement of appropriate materials in volumes indicated by these regions assists in the redistribution of residual stress in the superhard structure.

There are many ways in which PCD materials may be placed in relation to the critical regions and some of these combinations are described by way of example below. The resultant changes in residual stress may allow the different critical regions to be manipulated and altered in a partially independent manner and may be used to indicate the efficacy of each particular embodiment.

Figure 2A:
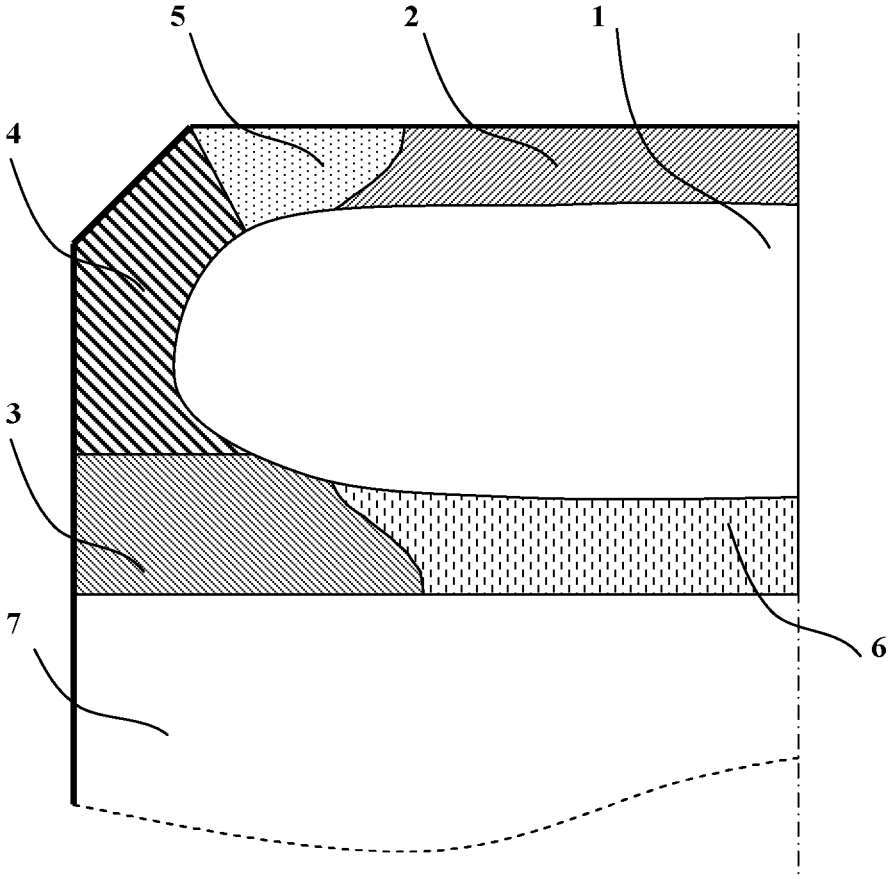
FIG. 2*a* is a schematic diagram of a half cross-section of a PCD body attached to a substrate, according to a first embodiment.

FIG. 2*a* shows a schematic partial view of the cross section of half of a body of superhard material such as a PCD material attached to a substrate, which indicates adjacent volumes associated with the regions of FIG. 1. These volumes may be made of materials differing in structure and composition and associated properties in order that stress distributions may be modified.

Figure 2B:
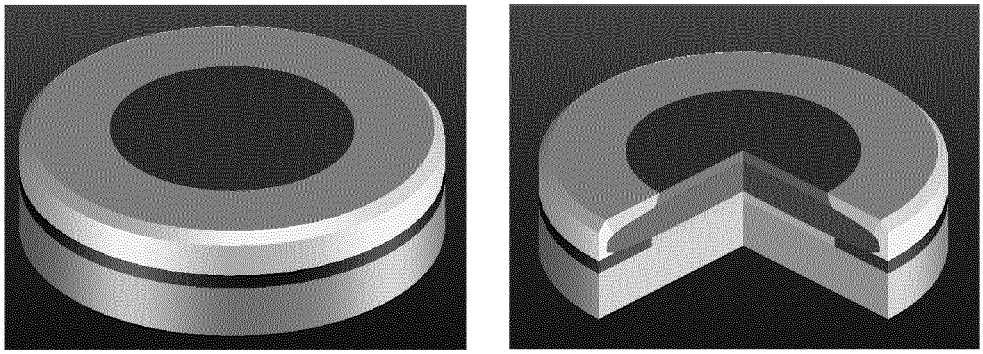
FIG. 2*b* is a partially sectioned three dimensional representation of the embodiment of FIG. 2*a* with a cutaway section to expose the internal arrangement of various regions.

FIG. 2*b* is three dimensional representation of the embodiment of FIG. 2*a* with a 60° cutaway section to expose the internal arrangement of the various regions. The first region 1 in these figures comprises mainly region D of FIG. 1 and occupies the general centre of the PCD table. It is surrounded by five adjacent and bonded regions 2, 3, 4, 5 and 6. The first volume 1 is separated from the circumferential free surface of the PCD table by the third 3, fourth 4, and fifth 5, regions. Any one or more of the second to the fifth regions 2, 3, 4, and 5 may have a discontinuity therein forming a gap through which the first region 1 and or the sixth region 6 may extend to the free peripheral surface (not shown). The substrate is labelled as 7. The sixth region 6 is positioned between the first central region 1 and the substrate 7, which may be for example a carbide substrate, and is associated or corresponds to region C in FIG. 1. The third region 3, is adjacent to the sixth region 2 and is situated adjacent the substrate 7 and the circumferential free surface of the PCD table. This region is associated with region A2 of FIG. 1.

The fourth region 4, is adjacent to the third region 3, and is situated at the circumferential free surface of the PCD table. This region 4 is associated with region A1 of FIG. 1. The fifth region 5, is adjacent to the fourth region 4 and separates the first region 1, from the top free surface of the PCD table. The fifth region 5, is associated with region B1 of FIG. 1.

The second region 2, is adjacent to the fifth region 5, and separates the first region 1 from the remainder of the top free surface of the PCD table. The second region 2 extends across the middle of the top free surface of the PCD table and is associated with region B2 of FIG. 1.

Material of the highest coefficient of thermal expansion may be chosen to occupy the first or the sixth regions 1 and 6. For example, in some embodiments the first region 1, may contain the material of highest coefficient of thermal expansion, and the materials chosen for the second to the sixth regions 2 to 6, may all differ from one another in regard to the coefficient of thermal expansion and all be lower in this property than the first region 1.

The material of the fifth region 5, may be lower in coefficient of thermal expansion than those of both fourth and second regions, 4 and 2. Similarly, the material of the sixth region 6, may be lower in coefficient of thermal expansion than that of the third region 3, and the material of the fourth region 4, may have a coefficient of thermal expansion lower than that of the third region 3.

Materials that may be used for forming the various regions include, for example, diamond containing materials such as PCD, and composites with other metals such as copper, tungsten and the like, and composites with ceramics such as silicon carbide, titanium carbide and nitride and the like. In addition, non diamond containing materials compatible with cutter structures and fabrication procedures may also be used and may include hard metals such as tungsten carbide/cobalt, titanium carbide/nickel and the like, cermets such as aluminium oxide, nickel combinations and the like, general ceramics and refractory metals.

In addition to utilising relative coefficient of thermal expansion differences in materials, the modulus of elasticity may be used to appropriately alter the stress field in the PCD cutter. In this example, the material of the first region 1, may be chosen to have the lowest modulus of elasticity as compared to the materials of the second to sixth regions, 2 to 6. Typical PCD materials often differ in both coefficient of expansion and modulus of elasticity. In the case of PCD material produced under high pressure high temperature conditions for diamond sintering, the stresses induced due to thermal expansion mismatch typically dominate.

In some embodiments, the first region 1, is of a sufficient proportion of the overall PCD table volume to have a significant influence on the stresses in the surrounding regions. For example, the first region 1 may occupy between around 30 and 95% of the overall PCD table volume. The adjacent boundaries between each of the second, third, fourth, fifth and sixth regions, 3, 4, 5 and 6, may be positioned in order to optimize the desired changes of stress distribution.

It is known in the art that typically but not exclusively PCD materials have linear thermal expansion coefficients within the range of $3\times10^{-6}$ to $5\times10^{-6}$ per degree Centigrade.

An example of the difference in linear coefficients of thermal expansion between the material of the first region 1, and the materials of each of the second to sixth regions 2 to 6, is at least around $0.3\times10^{-6}$ per degree Centigrade. Also, an example of the difference in linear coefficient of expansion between two adjacent materials is at least around $0.1\times10^{-6}$ per degree Centigrade. If region 4 is made from a sufficiently wear resistant material for adequate cutting performance such as PCD materials and the like, other hard materials fulfilling the thermal expansion criteria and preferences outlined above may be used in the other regions.

PCD materials may be considered as a combination of diamond and transition metals such as cobalt, nickel and the like. The linear thermal expansion coefficient of diamond is very low with a literature value of $0.8+/-0.1\times10^{-6}$ per degree Centigrade. Metals such as cobalt have high thermal expansion coefficients, typical of transition metals such as $13\times10^{-6}$ per degree Centigrade. The thermal expansion coefficients of typical PCD materials have a strong dependence upon the diamond to metal compositional ratio. A very convenient way of practically producing PCD material variants with differing thermal expansion coefficients is to manufacture PCD materials with significantly different metal contents. The metal content of PCD materials may typically, but not exclusively, fall in the range from 1 to 15 volume percent and materials with possibly as high as 25 volume percent metal may be produced.

Referring to the embodiment illustrated in FIG. 2*a*, the PCD material in the first region 1, has a metal content greater than the PCD material in the remaining regions 2 to 6, in order to alter the stress distribution in the PCD layer in the desired manner. In addition the metal content of the fifth region 5, may be less than the fourth and second regions 4 and 2. The metal content of the material of the second region 2, may be less than that of the third region 3, and the metal content of the material of the fourth region 4, may be less than or equal to that of the third region 3.

The difference in metal content between the PCD materials of the first region 1, and the second to sixth regions, 2 to 6, may be at least around 1.5 volume percent. Additionally, the difference in metal content between any of the adjacent materials of the second to the sixth regions 2 to 6, may be, for example, at least around 0.5 volume percent.

PCD materials made with large average grain sizes of diamond particles tend to have lower metal contents than those made with smaller average grain sizes. It is therefore practically possible to create PCD materials with differing metal contents with the attendant differing thermal expansion coefficient by means of choice of average grain size of the diamond particles.

In the embodiment shown in FIG. 2*a*, the average grain size of the material in the first region 1, may, for example, be smaller than the materials of the second to sixth regions 2 to 6.

Alternatively the average grain size of the material in the sixth region 6, may be smaller than that of the materials of all the other regions namely, regions 1 to 5.

In some embodiments, the average grain size of the material of the first region 1, falls in the range of around 1 to 10 microns and the average grain size of the material of the other regions 2 to 6 is greater than around 10 microns.

In a situation where the coefficients of thermal expansion of different structure PCD materials are similar, the differing moduli of elasticity may be used to induce relative stresses. In such an example, the modulus of elasticity in the material of the first region 1, or in the material of the sixth region 6, of FIG. 2*a* is greater than that of the materials in each of the other regions.

Typically, but not exclusively, PCD materials have modulus of elasticity within the range of around 750 to 1050 GPa. A difference in modulus of elasticity between materials in the first region 1, or that of the sixth region 6, and the materials of each of the remaining regions may be, for example, at least around 20 GPa.

If the material of the fourth region 4, is made from a sufficiently wear resistant material for adequate cutting performance, such as PCD materials and the like, other hard materials fulfilling the modulus of elasticity criteria and preferences outlined above may be used.

As mentioned previously, PCD materials may be considered to comprise a combination of diamond and transition metals such as cobalt, nickel and the like. Single crystal diamond is one of the stiffest materials known to man with an extremely high modulus of elasticity. PCD materials contain, as their greatest component, diamond grains which may be synthetic or natural, and which are intergrown together with the interstices filled with the transition metal. A way of modifying the elastic modulus is to change the overall diamond content. The higher the diamond content, the higher the value of the modulus of elasticity. The diamond content of PCD materials may typically but not exclusively fall in the range from 75 to 99 volume percent. In the examples where differences in modulus of elasticity are dominant in the generation of residual stresses then, referring to the embodiment of FIG. 2*a*, the PCD material of the first region 1, or that of the sixth region 6, may have diamond content more than the PCD materials in the remaining regions.

The difference in diamond content between the PCD materials of the first region 1 or the sixth region 6 and that of the remaining regions may, for example, be at least around 0.2 volume percent.

With reference to FIG. 2*a*, it is conceivable that the stress at the interface between the chosen different materials in adjacent regions is very high, resulting in a steep and undesirable stress gradient at these interfaces which may, by itself, be sites of localised crack initiation. To minimise or reduce this situation it may be desirable to graduate the structure and composition between the adjacent materials. Thus the diamond content, grain size and metal content may be selected to change gradually from one region to an adjacent region, over a distance of, for example, at least 3 times the largest average grain size of the materials.

Further embodiments may be arrived at by choosing materials in specific chosen volumes to have the same coefficients of thermal expansion.

Figure 3:
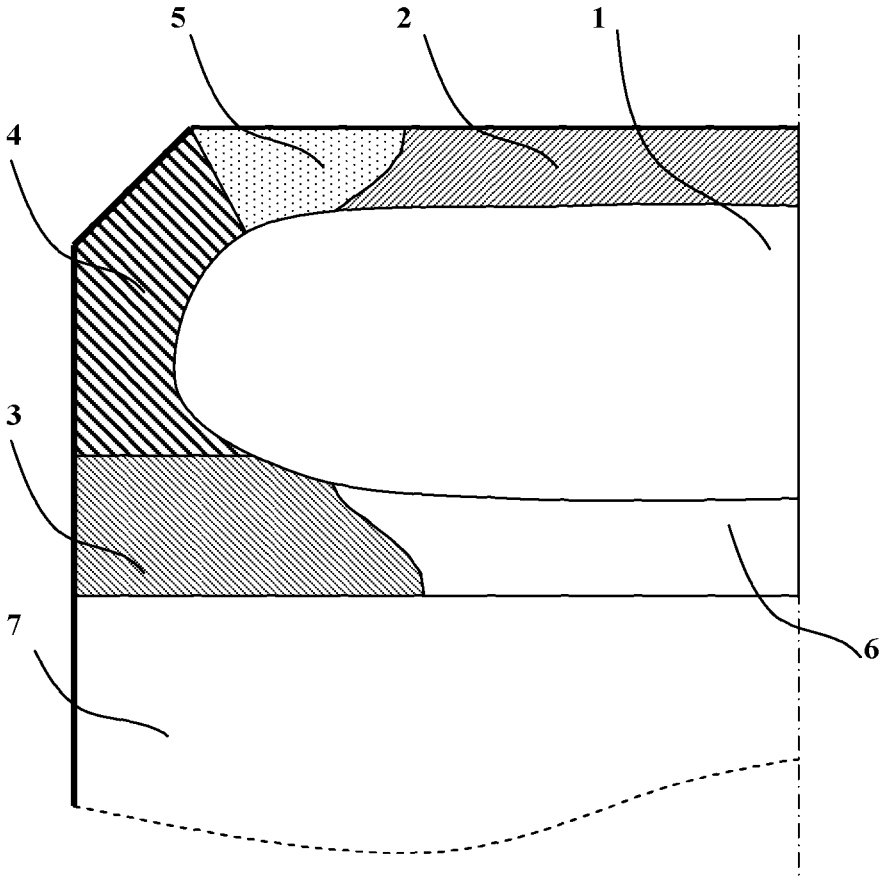
FIG. 3 is a schematic diagram of a half cross-section of a PCD body attached to a substrate, according to a second embodiment.

FIG. 3 is a schematic diagram of a PCD cutter where the first and sixth regions 1 and 6, have the same and the highest coefficient of thermal expansion and the second, third, fourth, and fifth regions 2, 3, 4, and 5, have materials with lower and different coefficients of thermal expansion. The material having the highest coefficient of thermal expansion extends to the PCD table-carbide substrate interface and is separated for part of its region from the circumferential free surface of the PCD table by material of lower coefficient of thermal expansion. The material having the highest coefficient of thermal expansion extends through one or more discontinuities (not shown) in any one or more of the second, third, fourth, and fifth regions 2, 3, 4, and 5, to the circumferential free surface of the PCD table.

Figure 4:
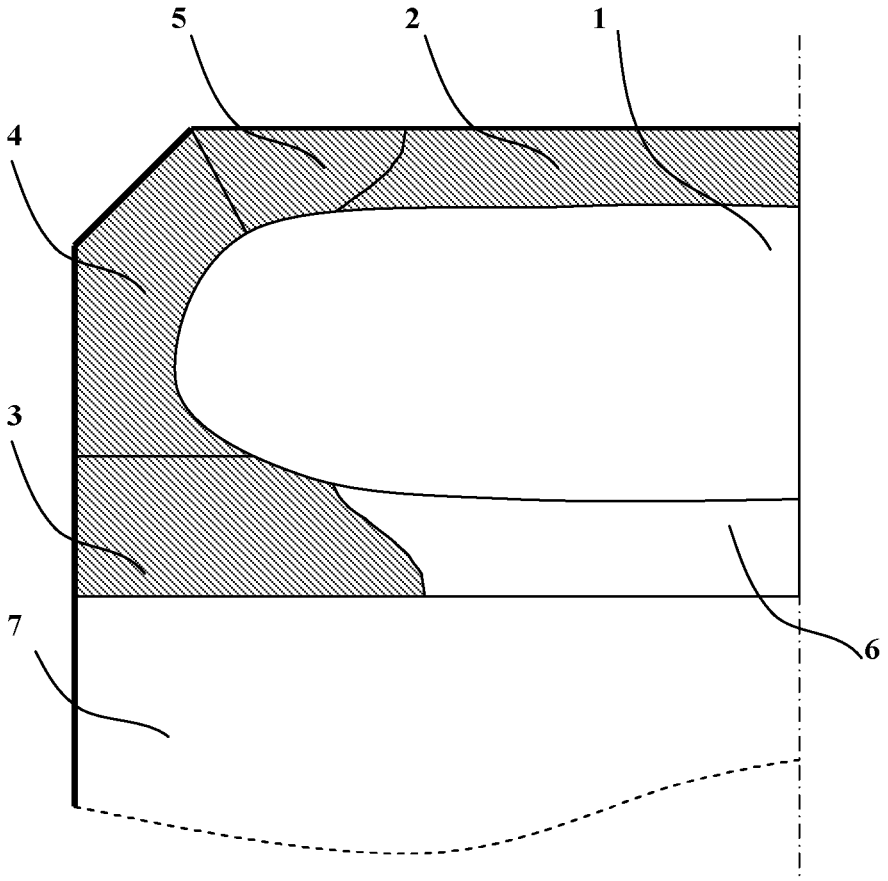
FIG. 4 is a schematic diagram of a half cross-section of a PCD body attached to a substrate, according to a third embodiment.

FIG. 4 is a schematic diagram of a PCD cutter which also has the first and sixth regions 1 and 6, with the same highest coefficient of thermal expansion but the materials of the second, third, fourth, and fifth regions 2, 3, 4, and 5, have equal lower coefficients of thermal expansion to one another. The PCD table of the cutter may now be considered as being made up of two regions differing in coefficient of thermal expansion, the region of highest coefficient of thermal expansion is situated symmetrically around the central axis at the interface of the PCD table and the substrate for part of its region from the circumferential free surface of the PCD table by material of lower coefficient of thermal expansion. The material having the highest coefficient of thermal expansion extends through one or more discontinuities (not shown) in any one or more of the second, third, fourth, and fifth regions 2, 3, 4, and 5, to the circumferential free surface of the PCD table.

Figure 2B:
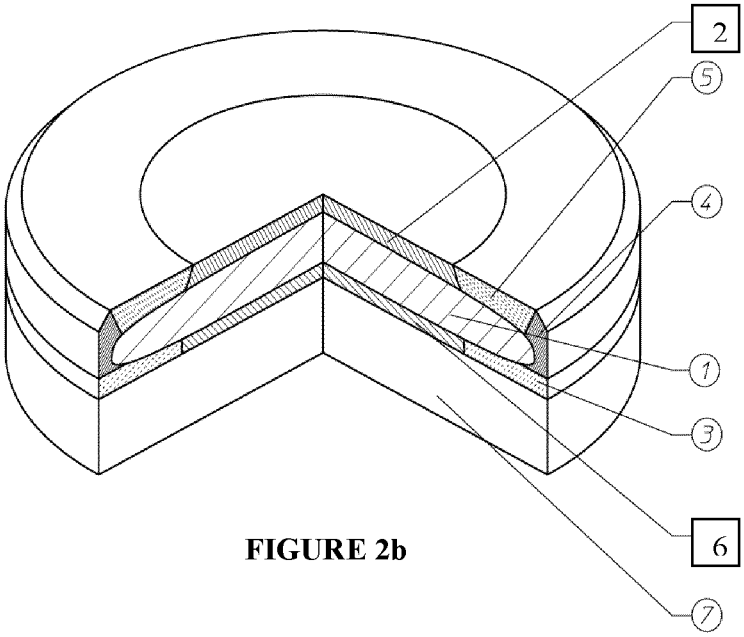

Cutters made according to FIGS. 2, 3 and 4 may result in a significant reduction of axial tensile stress in region A2 of FIG. 1 and the movement of both the tensile hoop stress of region A1 and the radial tensile stress of region B1 away from the free surface of the PCD. Embodiments of this nature as shown in FIGS. 3 and 4 may thus address the crack behaviour during the early and latter stages of wear of a cutter, respectively.

Figure 5:
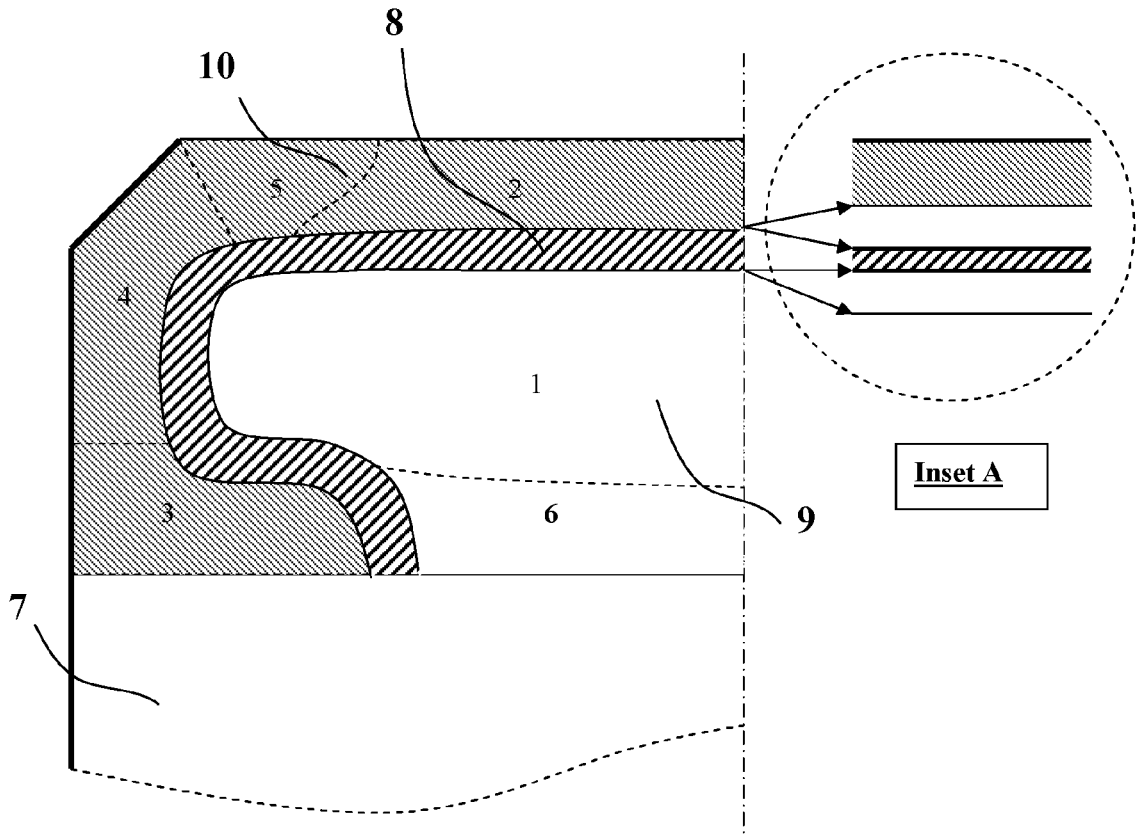
FIG. 5 is a schematic diagram of a half cross-section of a PCD body attached to a substrate, according to a fourth embodiment.

The boundaries between adjacent regions containing differing materials may be expanded to form new regions separating the adjacent region. In this way, more complex three dimensional designs may be exploited. FIG. 5 is a schematic diagram showing a cutter where the boundaries between the combined first and sixth regions 1 and 6 and the combined second, third, fourth, and fifth regions 2, 3, 4, and 5, of FIG. 4 are expanded to make a new separating volume labelled as the eighth region 8. In FIG. 5, the combined first and sixth region is now labelled as the ninth region 9, and the combined second, third, fourth, and fifth regions are shown as the tenth region 10. In one embodiment, the eighth, ninth and tenth regions 8, 9, 10 may be made from materials with differing coefficients of thermal expansion. For example, the eighth or the ninth region 8, 9 may be made of the material with the highest coefficient of thermal expansion.

In some embodiments, the material of the ninth region 9 has the highest coefficient of thermal expansion and the eighth and ninth regions 8, 9 differ in this property. Also, the material of the eighth region 8 may have an intermediate coefficient of thermal expansion between that of the ninth and tenth regions 9, 10.

Cutters made according to the latter example, may have a significant reduction of axial tensile stress in region A2 of FIG. 1 and due to this and the movement of the radial tensile stress of region B1, the hoop stresses in all the regions may be rendered compressive. The elimination of tensile hoop stresses would be a highly favourable outcome.

Figure 6:
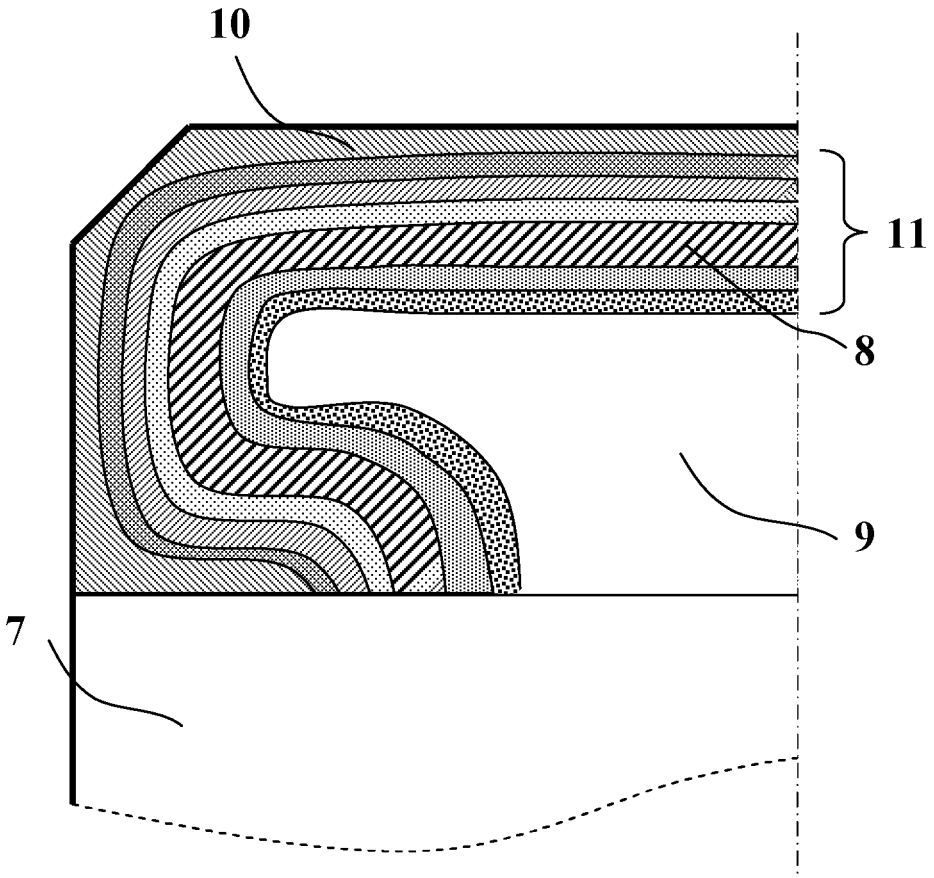
FIG. 6 is a schematic diagram of a half cross-section of a PCD body attached to a substrate, according to a fifth embodiment.

Further variants with increased numbers of regions of different materials may be arrived at by the expansion of the boundaries in FIG. 5, as indicated by the inset A. In this way, cutter designs may be arrived at with four or five regions whilst still retaining the geometric form of the original interfacial boundaries. By continuing this procedure of expanding boundaries to form new regions, cutter designs with multiple volumes still retaining the original interfacial boundary geometric form may be arrived at, as shown in FIG. 6.

A very large number of permutations of different materials organised in the multiple regions may be made. In some embodiments, the region containing the material of highest coefficient of thermal expansion having the largest relative volume, occupies the centre region of the carbide-PCD interface and there is a progressive reduction in coefficient of thermal expansion in each subsequent adjacent volume extending from the central region of the PCD table to the circumferential edge. In the case where the number of multiple regions becomes very large, the thickness of these regions approaches the dimensional scale of the microstructure of the material and thus a continuous graduation of the structure, composition and properties may result.

The PCD table may be largely or completely graduated in this manner, with the central region of the PCD table being located away from the circumferential free surface and occupied by material of the highest coefficient of thermal expansion.

With reference to FIG. 5, the material of the eighth region 8 may, on average, be intermediate in coefficient of thermal expansion between the ninth and tenth regions 9, 10, but arranged to be continuously graduated in structure composition and properties from the material of the ninth region 9 to that of the tenth region 10. This may be advantageous as it may enable any undesirable sharp change in stress from one region to the other to be mitigated.

Figure 7:
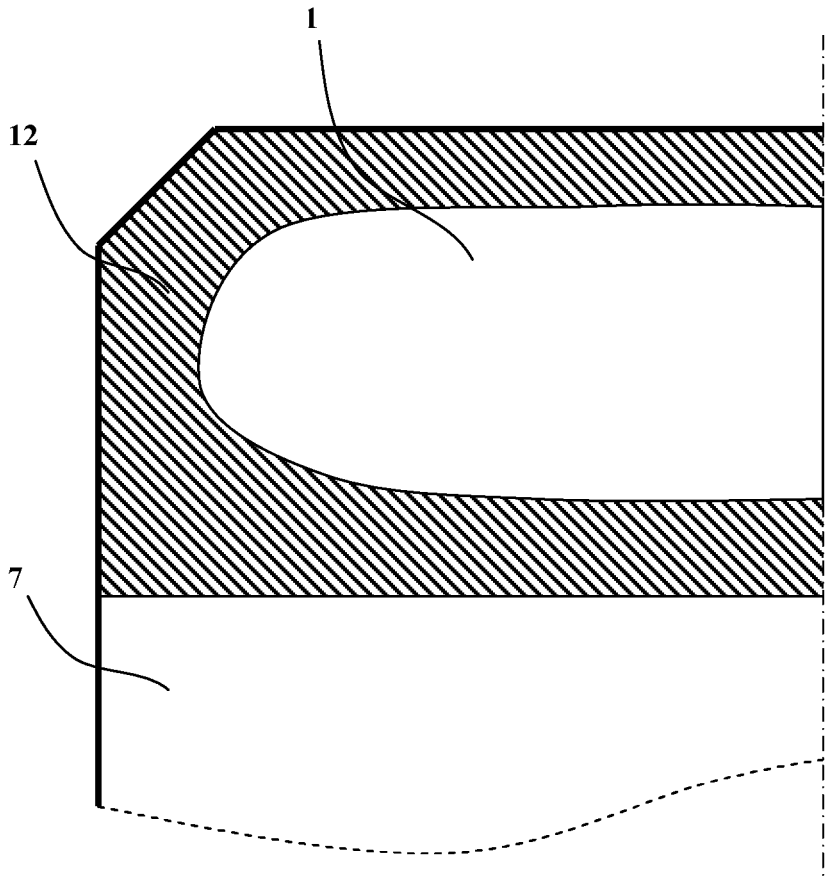
FIG. 7 is a schematic diagram of a half cross-section of a PCD body attached to a substrate, according to a sixth embodiment.

More embodiments may be arrived at by further considering FIG. 2 and choosing materials in specific chosen regions to have the same coefficients of thermal expansion. Any two or any three or any four or all of the second, third, fourth, fifth and sixth regions 2 to 6 may be made from materials having the same coefficient of thermal expansion. In addition the material of the first region 1 may be made equal in coefficient of thermal expansion to any of the materials in the second 2, fifth 5, and sixth 6 regions. Also, the second, third, fourth, fifth and sixth regions 2 to 6, may all be made of materials having the same coefficient of thermal expansion but still lower than the coefficient of thermal expansion of the material of the first region, 1, as shown in FIG. 7. The combination of the second, third, fourth, fifth and sixth regions is labelled 12 in this Figure.

Figure 8:
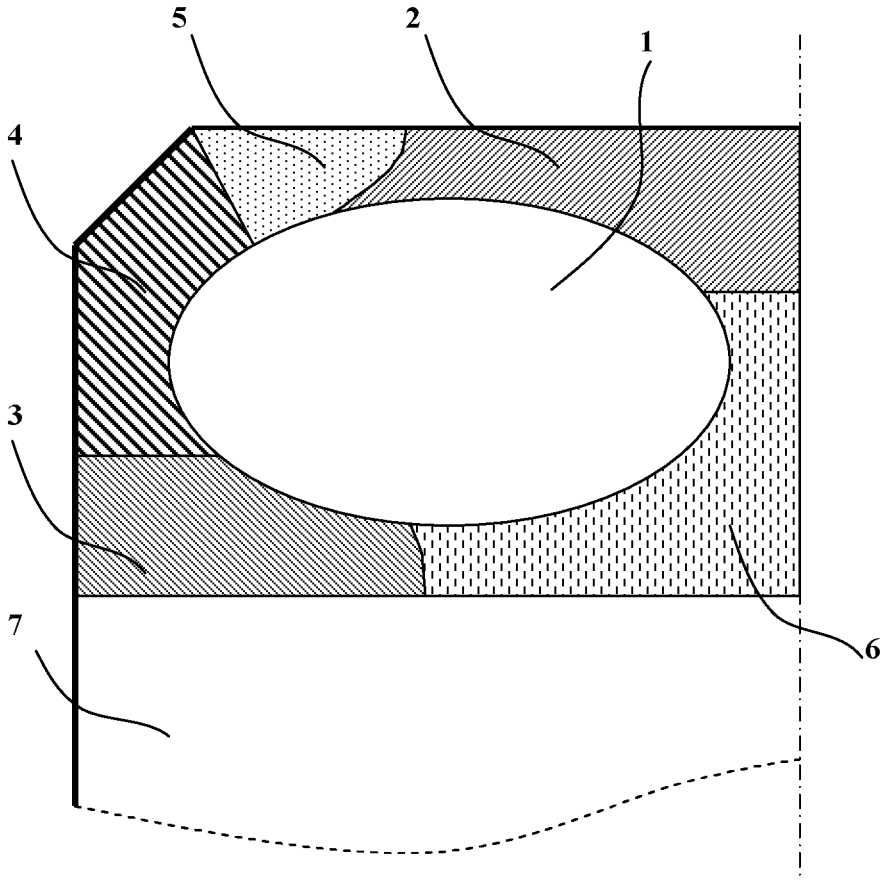
FIG. 8 is a schematic diagram of a half cross-section of a PCD body attached to a substrate, according to a seventh embodiment.

Cutters made according to the latter example, although not markedly changing the axial tensile stress of region A2 in FIG. 1, may however reduce both the radial tensile stress of B1 and the hoop stress of A1 along with importantly moving these two latter critical regions away from the free surface and into the body of the PCD table. Other embodiments may be arrived at from considering FIG. 2, for example with the first region 1 comprising the material of highest coefficient of thermal expansion occupying a generally toroidal volume remote from the free surfaces of the PCD table except through one or more discontinuities (not shown) in the surrounding region, and the carbide interface as shown in FIG. 8. Variants associated with permutations of the relative coefficients of thermal expansions of the materials in the second to sixth regions 2 to 6, may be applicable.

Figure 9:
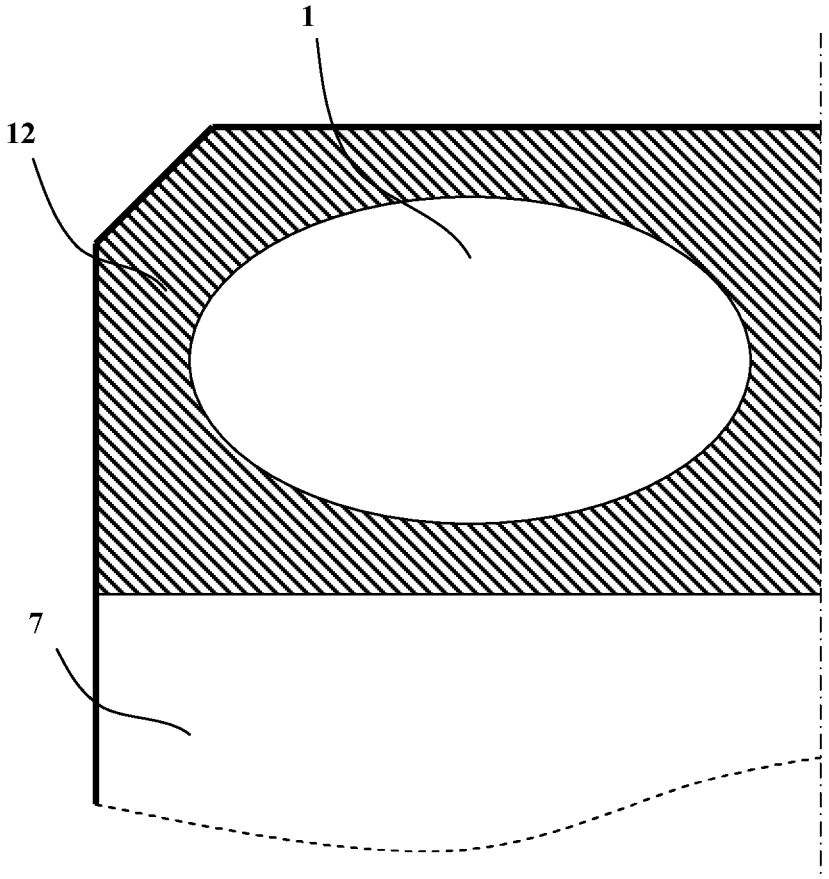
FIG. 9 is a schematic diagram of a half cross-section of a PCD body attached to a substrate, according to an eighth embodiment.

FIG. 9 is a schematic diagram where the second, third, fourth, fifth and sixth regions 2 to 6 of FIG. 8 are made of materials having the same coefficient of thermal expansion now labelled 11 which surrounds the toroidal first region 1, except through one or more discontinuities (not shown) in the surrounding region, enabling the material of the highest coefficient of thermal expansion to extend through one or more gaps therein to the free peripheral surface.

Figure 10:
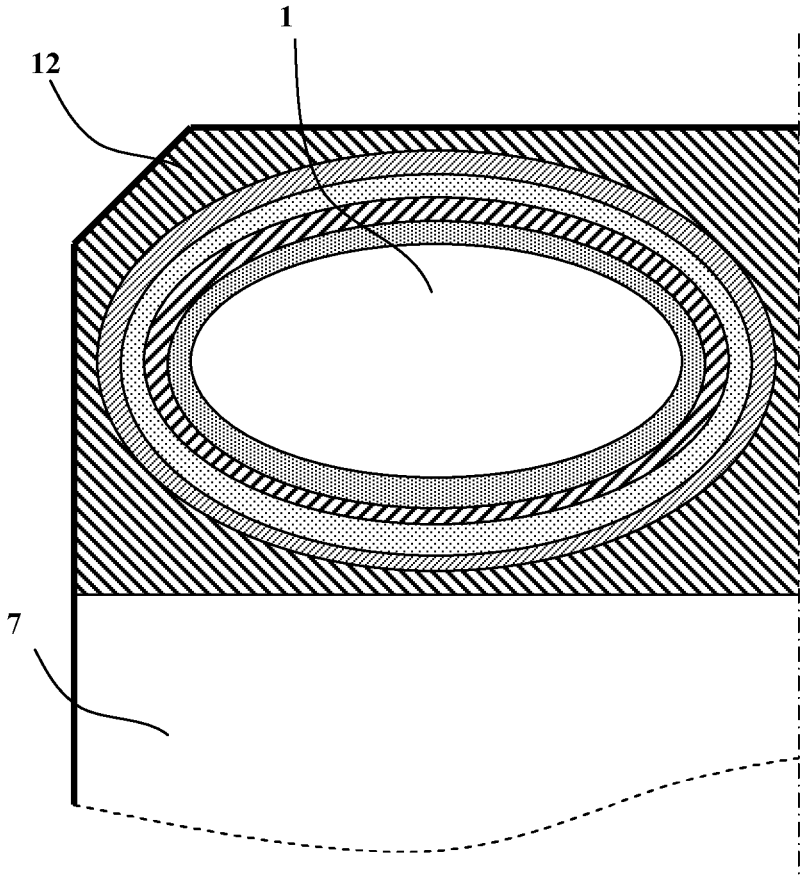
FIG. 10 is a schematic diagram of a half cross-section of a PCD body attached to a substrate, according to a ninth embodiment.

In addition, using the approach of expanding the boundaries between any of the regions to make new regions of materials with appropriate properties, designs with multiple regions may be derived for the designs shown in FIGS. 7, 8, and 9. An example with several new regions concentrically organised surrounding the toroidal first region 1, is shown in FIG. 10.

In regard to any one or more of the embodiments described, the region having the material of the highest coefficient of thermal expansion may be sub divided into more than one separate region, any number of which may be separated from the circumferential free surface of the PCD table by at least one material of lower coefficient of thermal expansion but one or more of which extends through a discontinuity in the material of lower coefficient of thermal expansion to the peripheral free surface. These multiple volumes of the same, highest coefficient of thermal expansion may be, for example any three dimensional geometric shape such as toroids, ellipsoids, cylinders, spheres and the like. The total volume of the material of the highest coefficient of thermal expansion may, for example, occupy 30 to 95% of the overall volume of the PCD table.

Figure 11:
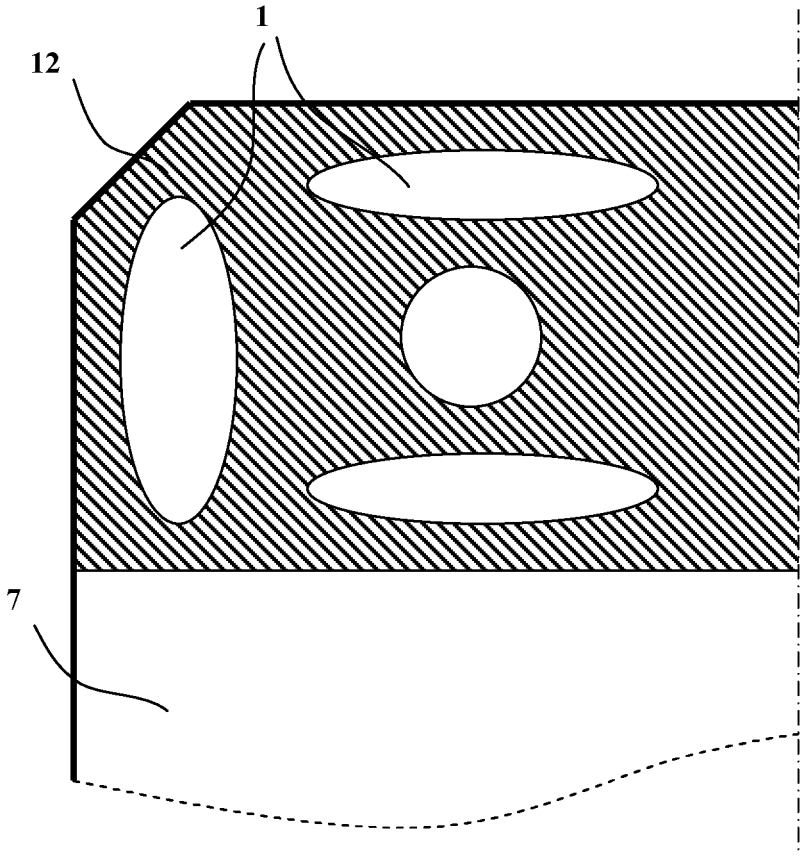
FIG. 11 is a schematic diagram of a half cross-section of a PCD body attached to a substrate, according to a tenth embodiment.
Figure 12:
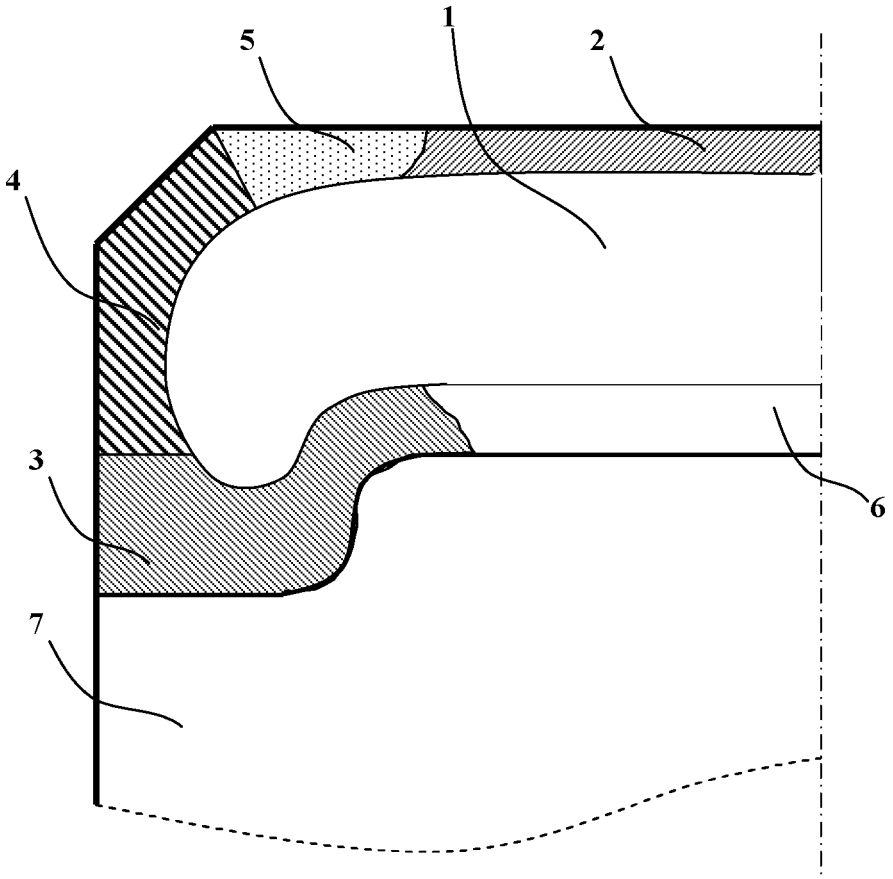
FIG. 12 is a schematic diagram of a half cross-section of a PCD body attached to a substrate, according to an eleventh embodiment.

FIG. 11 is an example with four substantially toroidal volumes distributed in the PCD table.

All of the embodiments so far described are axially symmetrical with regard to the common prior art cylindrical geometry cutter and are relatable to the critical regions of crack initiation and propagation as shown in FIG. 1. Generally, circumferential sub division of the volumes containing chosen dissimilar materials with their attendant dissimilar chosen properties, both axially symmetrical and asymmetrical, may be exploited to alter the residual stress distributions and may advantageously affect crack initiation and propagation. By using this approach the residual stress distribution may be altered from being axially symmetrical to axially asymmetrical so that undesired tensile stresses in the general location of the wear scar may be reduced or eliminated.

It is also conceived that a particular PCD material may, although being particularly good in terms of its wear properties and behaviour in rock cutting, not be an ideal material to have at the periphery of a cutter due to a less than ideal thermal coefficient of expansion and/or elastic modulus in regard to surrounding volumes and so have less than ideal residual stress in its volume. In such a case, any of the axisymmetric embodiments described and schematically represented by FIGS. 2 to 12 or any other such variants may be exploited to adjoin and abut a volume of such material such that the residual stress field within that volume's boundaries is favourably altered. "Abut" in this context means a supporting volume of material adjacent to a chosen sector which imposes favourable stress alterations on the said sector. This may be achieved by introducing discontinuities in the axisymmetric embodiments and "inserting" a volume of material to be used as the cutting region. Favourable alterations include reduction of tension, increases of compression and the displacement and movement of tensile stress maxima away from the free surface of the PCD table, particularly where these maxima are then separated from the free surface by compressive stress fields. A segment or sector of such a material with good wear behaviour may be inserted into a peripheral discontinuity created in any of the embodiments described and represented by FIGS. 2 to 12. This segment or sector will then be used as the site for the rock cutting and the subsequent formation of a wear scar. More than one such segments or sectors may be disposed at the periphery of the PCD table, either symmetrically or asymmetrically arranged, and facilitate multiple re-use of such cutters.

FEA analyses were carried out on cutters of the embodiments described having wear scars. It was concluded that the residual stress field is not materially altered as a result of the removal of PCD at the wear scar. The reason being that the volume of material removed at a typical wear scar is small in relation to the total PCD volume. The axial, radial and hoop tensile maxima of the residual stress field characteristic of any particular embodiment is neither significantly reduced in magnitude nor displaced in position by the progressive formation of wear scars of typical dimensions.

Referring to FIGS. 2 to 12, the third or fourth or fifth regions 3 to 5, or any combination of these regions is made circumferentially discontinuous (not shown) such that any one or more of the first region 1, the sixth region 6 or any region formed of the material having the highest coefficient of thermal expansion extends into the gap formed by the discontinuity and to the peripheral free surface of the PCD table.

Figure 13:
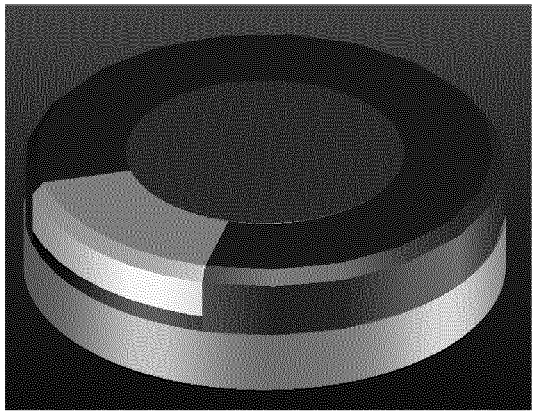
FIG. 13 is a schematic diagram with a cutaway section to expose the internal arrangement of various regions of an embodiment.
Figure 13:
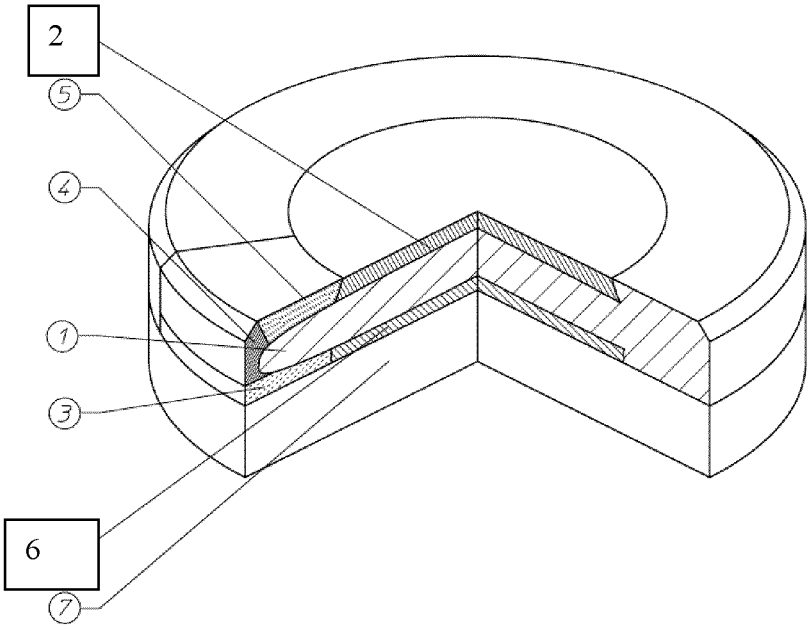

FIG. 13 is a schematic diagram of an example showing this discontinuity feature, where the combination of the third, fourth and fifth regions is circumferentially discontinuous and together forms a sector at the circumference of the superhard structure. In this embodiment, the sector may subtend around 60° at the axis. The first region 1 extends to the peripheral surface and may occupy, for example, a large or the greatest part of the circumference. The sector formed by the third, fourth and fifth regions 3 to 5 together is intended to be the rock cutting region where the wear scar may progressively be generated in use.

Alternatively there may be more than one circumferential discontinuity in the third, fourth and/or fifth regions or any combination of these regions resulting in the first region being surrounded by, for example, at least six or more regions derived from their segmentation. The first region 1 will then extend into the gaps between the segments, to the circumferential surface of the cutter. The multiple discontinuities and resultant sectors may be symmetrically or asymmetrically arranged around the circumferential periphery of the PCD table.

FIG. 14 is a schematic diagram of an example of a symmetrical arrangement.

Similarly the embodiments shown in FIGS. 3 to 10 and 12 may be modified by the introduction of circumferential discontinuities in the circumferential volumes. In addition, the embodiment presented in FIG. 11 may be modified by introducing one or more discontinuities in the toroidal volumes of material of highest coefficient of thermal expansion.

Some embodiments are now described in more detail with reference to the examples below which are not to be considered or intended to limit the invention.

Example 1

Figure 15:
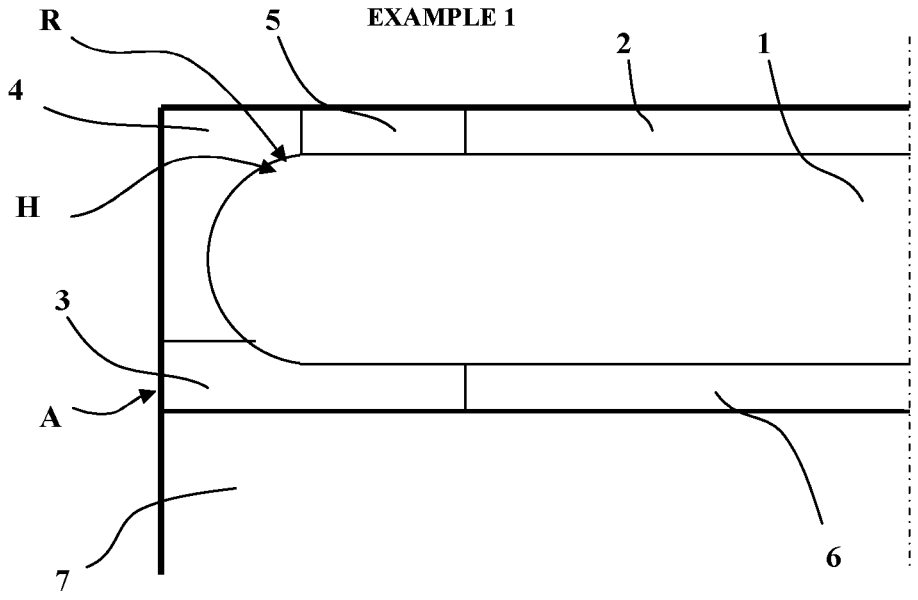
FIG. 15 is a schematic diagram of a half cross-section of a PCD body attached to a substrate, according to another embodiment.

PCD cutters based upon the embodiment of FIGS. 2*a*, 2*b* were manufactured. FIG. 15 is a diagram of the particular design employed for these cutters. The final PCD table thickness was 2.2 mm, bonded to a tungsten carbide, 13 weight percent cobalt hard metal substrate of 13.8 mm in length. The right cylinder cutters were 16 mm in diameter, 16 mm in overall length and had a planar interface between the PCD table and the carbide substrate.

With reference to FIG. 15, the volumes of differing PCD materials, 1 to 6, were made by using tape casting fabrication techniques known in the art. Green state discs or washers of six different diamond powders were made using a water soluble binder. In each case, the assembly of discs and washers to form the geometry of FIG. 15 was contained in a refractory metal cup, which, in turn, was fitted over a cylinder of pre-sintered tungsten carbide/cobalt hard metal. These assemblies were then vacuum degassed in a furnace at a temperature and time sufficient to remove the binder materials. The assemblies were then subjected to a temperature of about 1450° C. at a pressure of about 5.5 GPa in a high pressure apparatus. At these conditions, the cobalt binder of the tungsten carbide hard metal melted and infiltrated the porosity of the diamond power assembly and diamond sintering took place.

After the sintering of the diamond was complete the conditions were dropped to room temperature and pressure. At high pressure and temperature the materials of the cutter are at thermo-elastic equilibrium. After the quench to room conditions the property differences between the various PCD materials and the hard metal substrate set up a resultant residual stress distribution in the cutter PCD table.

With reference to FIG. 15, the six regions of differing PCD materials were made as follows.

The material of the first region 1, was made from diamond powder of average particle size of about 6 microns with a multimodal size distribution extending from 2 microns to 16 microns. This diamond powder is known to form PCD material at the high pressure and temperature conditions used, with a cobalt content of about 12 volume percent, with a linear coefficient of thermal expansion of $4.5\times10^{-6}$/° C. and an elastic modulus of 860 GPa. This is the material of highest coefficient of thermal expansion.

The material of the second region 2, was made from a diamond powder of average particle size of about 12.5 micron with a multimodal size distribution, extending from 2 microns to 30 micron. This diamond powder is known to form PCD material at the high pressure and temperature conditions used, with a cobalt content of 10.2 volume percent, with a linear coefficient of thermal expansion of $4.15\times10^{-6}$/° C. and an elastic modulus of 980 GPa.

The material of the third region 3, was made from a diamond powder of average particle size of about 5.7 micron with a multimodal size distribution, extending from 1 micron to 12 micron. This diamond powder is known to form PCD material at the high pressure and temperature conditions used, with a cobalt content of 10 volume percent, with a linear coefficient of thermal expansion of $4.0\times10^{-6}$/° C. and an elastic modulus of 1005 GPa.

The material of the fourth region 4, was made from a diamond powder of average particle size of about 25 microns with a multimodal size distribution, extending from 4 microns to 45 microns. This diamond powder is known to form PCD material at the high pressure and temperature conditions used, with a cobalt content of 7.7 volume percent, with a linear coefficient of thermal expansion of $3.7\times10^{-6}$/° C. and an elastic modulus of 1030 GPa.

The material of the fifth region 5, was made from a diamond powder of average particle size of about 33.5 microns with a multimodal size distribution, extending from 4 microns to 75 microns. This diamond powder is known to form PCD material at the high pressure and temperature conditions used, with a cobalt content of 7.0 volume percent, with a linear coefficient of thermal expansion of $3.4\times10^{-6}$/°

C. and an elastic modulus of 1040 GPa. This is the material of lowest coefficient of thermal expansion with the highest diamond content of 93 volume percent.

The material of the sixth region 6, was made from a diamond powder of average particle size of about 6.4 microns with a trimodal size distribution, extending from 3 microns to 16 microns. This diamond powder is known to form PCD material at the high pressure and temperature conditions used, with a cobalt content of 11.5 volume percent, with a linear coefficient of thermal expansion of $4.25\times10^{-6}$/° C. and an elastic modulus of 925 GPa.

After removal from the high pressure apparatus, each cutter was brought to final size by grinding and polishing procedures known in the art. A sample of the cutters was cut and cross-sectioned and the dimensions of the volumes of different PCD materials measured and their volumes relative to the overall volume of the PCD table estimated.

It was estimated that the material of the first region 1, made up of the material of highest coefficient of thermal expansion, occupied approximately 75% of the overall volume of the PCD table.

The material of the sixth region 6, occupied approximately 3% of the overall PCD table volume, extended radially approximately 4 mm from the central axis and was about 0.25 mm in thickness and separated the material of the first region 1, from the tungsten carbide, hard metal substrate.

The material of the third region 3, occupied approximately 8% of the overall PCD table volume, was adjacent to the material of the sixth region 6, extended radially a further 4 mm to the peripheral free surface of the table, was about 0.25 mm in thickness and separated the material of the first region 1, from the tungsten carbide, hard metal substrate.

The material of the fourth region 4, occupied approximately 5% of the overall PCD table volume, was adjacent to the material of the third region 3, was situated at the circumferential free surface of the PCD table.

The material of the fifth region 5, occupied approximately 6% of the overall PCD table volume, was adjacent to the material of the fourth volume, 4, and was approximately 0.25 mm thick and separated the material of the first region 1, from the top free surface of the PCD table.

The material of the second region 2, occupied approximately 3% of the overall PCD table volume, was about 0.25 mm in thickness, was adjacent to the material of the fifth region 5, extended radially approximately 4 mm from the central axis, extended across the middle of the top free surface of the cutter and separated the material of the first region 1, from the top free surface of the cutter.

The cutters as manufactured with the resultant measured volume dimensions and expected PCD material properties were modelled using Finite Element Analysis (FEA). This is a numerical stress analysis technique which allows the calculation of the stress distribution over the dimensions of the cutter. For comparative purposes, the stress distribution of a planar cutter with the table made solely of one material corresponding to the material of the fourth region 4, was calculated and used as reference.

Figure 16A:
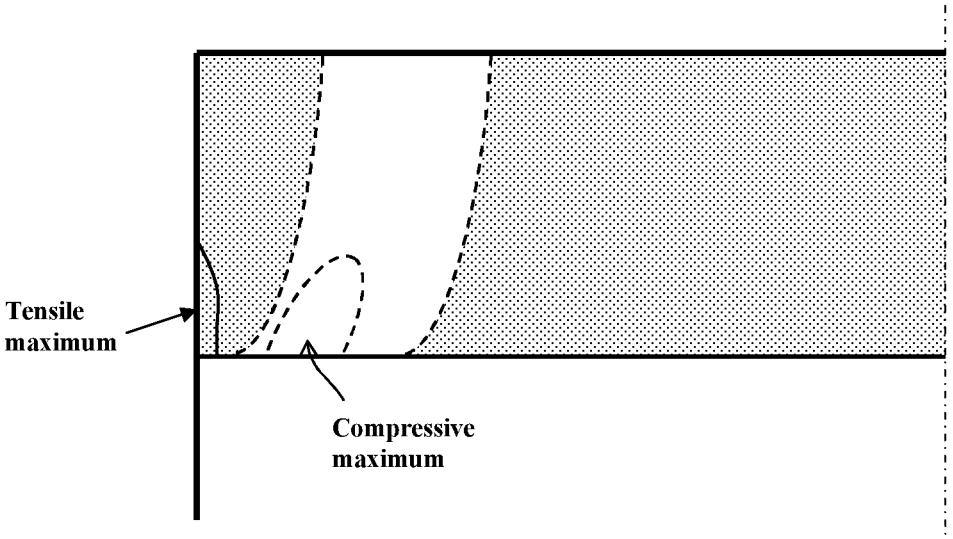
FIGS. 16 *a, b, c* are schematic representations of the stress distribution in a conventional planar cutter made from one PCD material only, showing the axial, radial and hoop tensile and compressive stress fields, respectively, together with the position of the tensile and compressive maxima.

FIGS. 16*a, b, c* are a schematic representation of the stress distribution in such a planar cutter made from one PCD material only.

FIG. 16*a* shows the axial tensile and compressive fields together with the position of the tensile and compressive maxima. The dotted lines indicate the boundary between the tensile and compressive fields, the tensile field being hatched. It may be seen that the axial tensile maximum is situated at the circumferential free surface of the PCD table immediately above the interface with the substrate. This axial tensile maximum is associated with the A2 critical region of FIG. 1. Most of the PCD table is in axial tension except for an axial compressive stress field which extends from the substrate interface to the top free surface of the PCD and is separated from the circumferential free surface by an axial tensile field. The compressive maximum is positioned inside the compressive field immediately above the substrate interface.

Figure 16B:
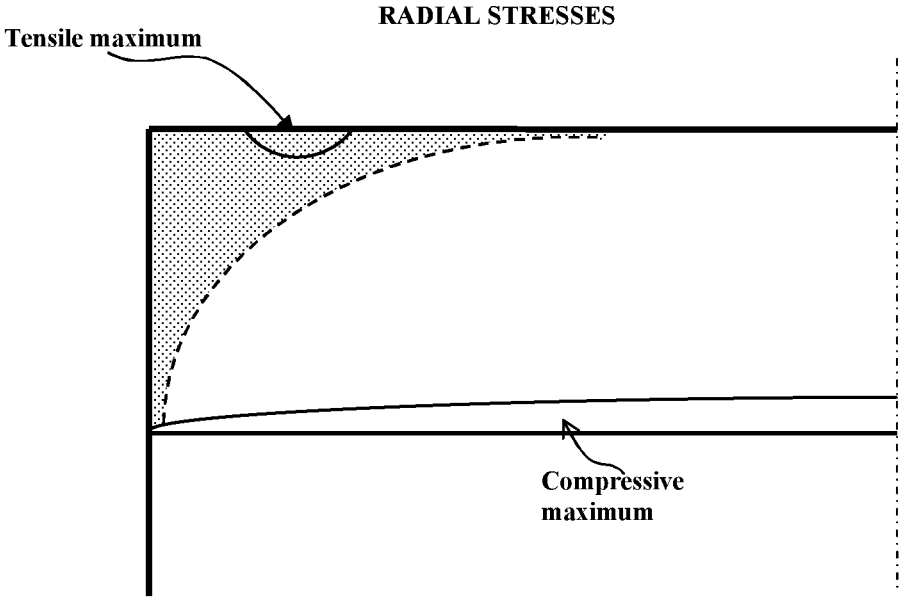

FIG. 16*b* shows the radial tensile and compressive fields together with the position of the tensile and compressive maxima. The single radial tensile field is hatched as shown in the FIG. 16*b*, the radial tensile maximum being situated at the top free surface of the PCD table. This radial maximum is associated with the B1 critical region of FIG. 1. The compressive maximum is situated at the substrate interface as shown.

Figure 16C:
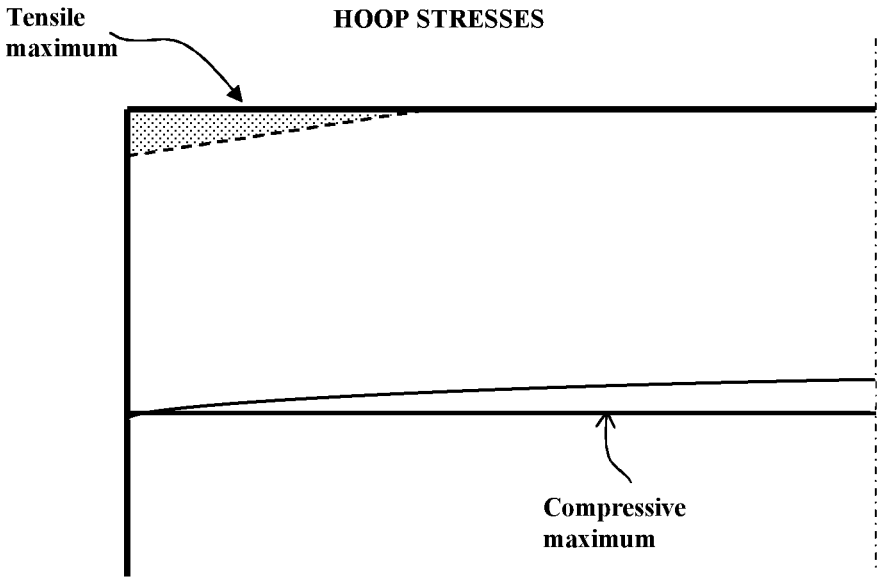

FIG. 16*c* shows the hoop tensile and compressive fields together with the position of the tensile and compressive maxima. Most of the PCD table is in hoop compression apart from a limited volume at the circumferential top corner which is in tension as shown by the hatched area. The hoop tensile maximum is situated at the free surface and is associated with the A1 critical region of FIG. 1.

Table 1, below gives the comparative FEA results expressed as the magnitude of the components of stress for this example compared the reference planar cutter.

TABLE 1

| Stress Component | Reference single volume Planar Cutter Stress Maxima MPa | Example 1 cutters Stress Maxima MPa | Comparison Normalised Reduction |
|---|---|---|---|
| Axial | 1077 | 735 | 32% |
| Radial | 324 | 231 | 29% |
| Hoop | 62 | −16 | 126% |

It may be seen from Table 1 that the axial tensile maximum associated with the critical region A2 of FIG. 1 has been reduced by 32%. The position of this maximum is unchanged from that in FIG. 16*a* as indicated by A in FIG. 15.

The radial tensile maximum associated with critical region B1 of FIG. 1 is similarly reduced by 29%. However, the position of this maximum is displaced and moved away from the free surface of the PCD cutter, occupying a position inside the material of region 1 as indicated by R in FIG. 15.

The hoop tensile maximum associated with critical region A1 of FIG. 1 is reduced by 126% and so now has become a position of lowest compression and has been displaced and moved away from the free surface of the PCD table. It now occupies a position inside the material of region 1 as indicated by H in FIG. 15. Moreover, the whole of the volume of the PCD table is now under hoop compression and there is hence an absence of any hoop tensile stress. It is thus seen that the critical regions A2, B1 and A1 have been significantly reduced in tension as compared to the reference planar one material cutter. In the case of critical regions B1 and A1, they have been moved away from the free surface of the PCD table and are separated from the top free surface by material which is in radial and hoop compression.

In summary, the FEA analysis of the cutters of Example 1, made to correspond to the general embodiment of FIGS. 2*a* and *b*, show that the stress in the critical regions of FIG. 1 where cracks preferentially propagate, is reduced in tension or increased in compression. In addition, some of the critical regions are displaced so that they are no longer bounded by the free surfaces of the PCD table. In this way, the tendency for cracks to propagate to the free surface of the cutter is expected to be inhibited or probably prevented. A reduction in the occurrence of spalling and an increase in cutter life in drilling applications are thus implied for cutters of this general design.

Example 2

Figure 17:
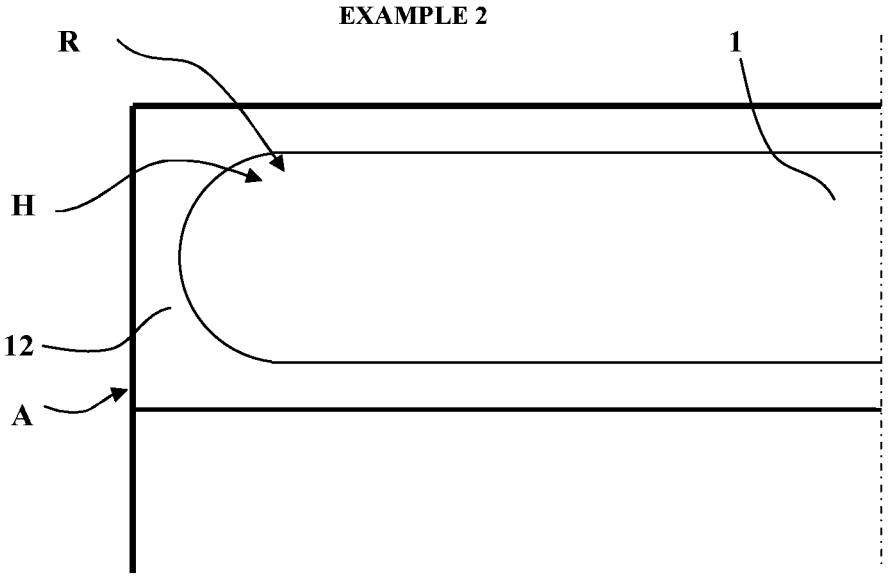
FIG. 17 is a schematic diagram of a half cross-section of a PCD body attached to a substrate, according to an embodiment derived from FIG. 7.

PCD cutters based upon the embodiment of FIG. 7 were manufactured. FIG. 17 is a diagram of the particular design employed for these cutters. As in example 1, the final PCD table thickness was 2.2 mm, bonded to a tungsten carbide, 13 weight percent cobalt hard metal substrate of 13.8 mm in length. The right cylinder cutters were 16 mm in diameter, 16 mm in overall length and had a planar interface between the PCD table and the carbide substrate.

In this example the PCD table is made from only two volumes of different PCD material. The PCD material of highest coefficient of thermal expansion formed a disc, labelled as 1 in FIG. 17, which is separated from the substrate interface, the top surface and the circumferential free surface of the PCD table, in part, by a volume of PCD material of lower coefficient of thermal expansion, labelled as 12 in FIG. 17. Not shown is the discontinuity in the region 12 through which the material forming the disc 1 extends to the peripheral free surface.

The manufacturing techniques and procedures as described in Example 1 above were used.

In this case, however, the temperature and pressure conditions employed were about 1470° C. and 5.7 GPa, respectively.

With reference to FIG. 17, the two regions of differing PCD materials were made as follows.

The first region 1, was made from diamond powder of average particle size of about 12.6 microns with a multimodal size distribution extending from 2 microns to 16 microns. This diamond powder is known to form PCD material at the high pressure and temperature conditions used, with a cobalt content of about 9 volume percent, with a linear coefficient of thermal expansion of $4.0\times10^{-6}$/° C. and an elastic modulus of 1020 GPa. This is the material of highest coefficient of thermal expansion.

The second region 12 in FIG. 17 was made from diamond powder of average particle size of about 33 microns with a multimodal size distribution extending from 6 microns to 75 microns. This diamond powder is known to form PCD material at the high pressure and temperature conditions used, with a cobalt content of about 6.5 volume percent, with a linear coefficient of thermal expansion of $3.4\times10^{-6}$/° C. and an elastic modulus of 1040 GPa.

After removal from the high pressure apparatus, each cutter was brought to final size by grinding and polishing procedures known in the art. A sample of the cutters was cut and cross-sectioned and the dimensions of the volumes of different PCD materials measured and their volumes relative to the overall volume of the PCD table estimated.

It was estimated that the first region 1, made up of the material of highest coefficient of thermal expansion, occupied approximately 67% of the overall volume of the PCD table and that of the surrounding volume about 33%. The first region 1, was separated from the substrate by about 0.25 mm, from the top surface of the table by about 0.4 mm and, in the most part, from the circumferential free surface of the table by about 0.4 mm.

The cutters as manufactured with the resultant measured volume dimensions and expected PCD material properties were modelled using Finite Element Analysis (FEA). This technique allows the calculation of the stress distribution over the dimensions of the cutter. For comparative purposes the stress distribution of a planar cutter with the table made solely of one material corresponding to the material of the surrounding volume, labelled 12 in FIG. 17, was calculated and used as reference. Table 2, below gives the FEA results expressed as the principle stress maxima and also as the components of the principle stress in the convenient cylindrical coordinates, axial, radial and hoop.

TABLE 2

| Stress Component | Reference single volume Planar Cutter with outer volume material Stress Maxima/MPa | Example 2. cutters Stress Maxima/MPa | Comparison Normalised Reduction |
|---|---|---|---|
| Axial | 1130 | 1026 | 9% |
| Radial | 376 | 353 | 6% |
| Hoop | 73 | 155 | 12% (increase) |

It may be seen from Table 2, that the tensile axial and radial stress maxima have been reduced in magnitude by about 9% and 6%, respectively. However the hoop component tensile stress maximum has been increased in magnitude by about 12%.

It was also noted that the position of the axial maximum was unchanged, labelled A in FIG. 17 and that a field of intensified axial compression, of magnitude −424 MPa, had been formed immediately adjacent to the first region 1, boundary and separated that volume from the circumferential free surface of the PCD table.

The positional change of the radial and hoop stress tensile maxima was noted. Both the radial and hoop tensile maxima have been displaced and now occupy positions inside the boundaries of the first region 1, labelled R and H respectively in FIG. 17 and are thus separated from the free surface of the PCD table by substantial volumes of radial and hoop compression. The displacement of the hoop maximum tensile stress counteracts the increase in magnitude when crack propagation is considered. Although propagating cracks will be attracted by these tensile stresses, the cracks will be inhibited from passage through the material in compression separating the tensile regions from the free surfaces. Thus cracks cannot easily reach the free surfaces and cause spalling.

It was thus indicated by FEA that cutters made according to the embodiment of FIG. 7, are likely to have a reduction of axial tensile stress of region A2 in FIG. 1, together with an intensified adjacent axial compression. The tensile radial stress of region B1 was reduced and moved so that it was no longer bounded by the top free surface of the PCD table, and was separated from the top free surface by a zone of radial compression. In addition, although the tensile hoop stress maximum associated with critical region A1 was not reduced but, in fact increased; it too was moved away from the free surface of the PCD table. This tensile hoop maximum now occupied an immediately adjacent position inside the first region 1, and was completely surrounded by hoop compression separating it from all the free surfaces of the PCD table and the substrate interface.

Taking these results together it would be expected that in a drilling application, cracks propagating behind the wear scar of such cutters will be inhibited in their progress and will not cross the compression barriers separating them from the PCD table free surfaces. Such cracks may remain in the body of the PCD table and thereby act to inhibit spalling and premature failure of cutters of this design.

Example 3

Figure 18A:
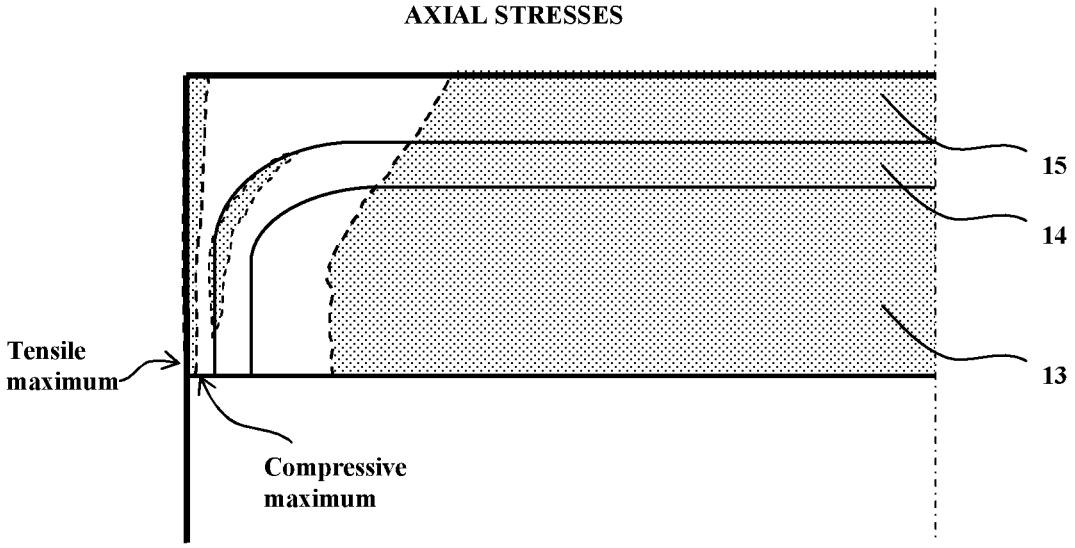
FIGS. 18*a, b* and *c* are schematic representations showing the stress distribution in a cutter according to an embodiment where the axial, radial and hoop tensile and compressive stress fields, respectively, are shown together with the position of the tensile and compressive maxima.

PCD cutters were made as per FIG. 18*a* which is a specific design based upon the embodiment of FIG. 5, where the PCD table is made from three volumes of different PCD material. The PCD material of highest coefficient of thermal expansion, and highest metal content formed a disc, labelled as 13 in FIG. 16*a*, which was situated at the substrate interface centrally and symmetrically arranged around the central axis of the cutter. The volume of material, made from a PCD material of lowest coefficient of thermal expansion and metal content labelled 15 in FIG. 18*a*, extended across the free top surface of the PCD table and the majority of the peripheral free surface with the exception of a portion thereof which formed a discontinuity through which the PCD material of highest coefficient of thermal expansion extended (not shown). A PCD material made from a material of intermediate coefficient of thermal expansion and metal content, as compared to the materials of regions 13 and 15 labelled 14 in FIG. 18*a*, occupied a volume which separated regions 13 and 15.

The final PCD table thickness was 2.2 mm, bonded to a tungsten carbide, 13% weight cobalt hard metal substrate of 13.8 mm length. The right cylinder cutters were 16 mm in diameter and had a planar interface between the PCD table and the carbide substrate.

As in examples 1 and 2, tape casting techniques known in the art, were used to form so called green state discs and washers of three appropriately chosen diamond powders bonded with water soluble organic binders. By assembling these discs and washers in a refractory metal container, the geometry of FIG. 18*a* was produced. A cylinder of tungsten carbide, 13% cobalt hard metal cylinder was then inserted into the refractory metal container to form and provide the substrate.

These assemblies were then vacuum degassed in a furnace at a temperature and time sufficient to drive off the binder materials. The assemblies were then subjected to a temperature of about 1460° C. at a pressure of about 5.6 GPa in a high pressure apparatus, as well established in the art. At these conditions the cobalt binder of the tungsten carbide hard metal binder melted and infiltrated the porosity of the diamond power assembly and diamond sintering took place. After the sintering of the diamond was complete the conditions were dropped to room temperature and pressure. At high pressure and temperature the materials of the cutter are at thermo-elastic equilibrium. After the quench to room conditions, the property differences between the various PCD materials together with that to the hard metal substrate set up the resultant stress distribution in the cutter PCD table.

With reference to FIG. 18*a*, the three regions of differing PCD materials were made as follows.

The PCD material of region 13 of FIG. 18*a* was made from diamond powder of average particle size of about 5.7 microns with a multimodal size distribution extending from 1 micron to 12 micron. This diamond powder is known to form PCD material at the high pressure and temperature conditions used, with a cobalt content of about 10 volume percent, with a linear coefficient of thermal expansion of $4.1\times10^{-6}$/° C. and an elastic modulus of 1006 GPa. This is the material of highest coefficient of thermal expansion and highest metal content.

The outer region 15, in FIG. 18*a*, was made from diamond powder of average particle size of about 25 microns with a multimodal size distribution extending from 4 microns to 45 microns. This diamond powder is known to form PCD material at the high pressure and temperature conditions used, with a cobalt content of about 7.4 volume percent, with a linear coefficient of thermal expansion of $3.6\times10^{-6}$/° C. and an elastic modulus of 1030 GPa.

The intermediate region 14, in FIG. 18*a*, was made from diamond powder of average particle size of about 12.6 microns with a multimodal size distribution extending from 2 microns to 30 microns. This diamond powder is known to form PCD material at the high pressure and temperature conditions used, with a cobalt content of about 8.9 volume percent, with a linear coefficient of thermal expansion of $3.9\times10^{-6}$/° C. and an elastic modulus of 1020 GPa After removal from the high pressure apparatus, each cutter was brought to final size by grinding and polishing procedures known in the art. A sample of the cutters was cut and cross-sectioned and the dimensions of the volumes of different PCD materials measured and their volumes relative to the overall volume of the PCD table estimated. The boundary between the regions 13 and 14 was situated about 1.0 mm axially away from the substrate interface and about 0.5 mm from the circumferential free surface. The boundary between the regions 15 and 14 is situated about 0.6 mm away from the top free surface of the PCD table and about 0.25 mm from the circumferential free surface.

Region 13 was estimated to be approximately 38% of the overall volume of the PCD table. Regions 14 and 15 were estimated to be approximately 23% and 47% of the overall volume of the PCD table, respectively.

The cutters as manufactured with the resultant measured volume dimensions and expected PCD material properties were modelled using Finite Element Analysis (FEA). This technique allows the calculation of the stress distribution over the dimensions of the cutter. For comparative purposes the stress distribution of a planar cutter with the table made solely of one material corresponding to the material of the surrounding region, labelled 15 in FIG. 18*a*, was calculated and used as reference. FIGS. 16 *a, b* and *c* show the positions and extent of the tensile and compressive stress resolved into the axial, radial and hoop directions, respectively, for this reference planar cutter. Similarly, FIGS. 18*a, b* and *c* show the resolved stresses as calculated for the current example. The tensile stress is indicated by hatches and the boundaries between tension and compression by dotted lines. The positions of the tensile and compressive maxima are also indicated on the diagrams. The axial tensile maximum for the reference cutter in FIG. 16*a* is associated with the critical region A2 of FIG. 1, the radial tensile maximum in FIG. 16*b* is associated with the critical region B1 of FIG. 1 and the hoop tensile maximum in FIG. 16*c* is associated with the critical region A1 of FIG. 1.

Table 3 gives the comparative FEA results expressed as the stress maxima of the components of the convenient cylindrical coordinates, axial, radial and hoop of the cutter of Example 3 of FIGS. 18*a, b* and *c* relative to the reference planar cutter (FIGS. 16*a, b* and *c*).

TABLE 3

| Stress Component | Reference single volume Planar Cutter with outer volume material Stress Maxima MPa | Example 3 cutters Stress Maxima MPa | Comparison Normalised Reduction |
|---|---|---|---|
| Axial | 1137 | 633 | 44% |
| Radial | 342 | 195 | 43% |
| Hoop | 65 | −70 (Compressive) | 208% (Compressive) |

Table 3 clearly shows that the stress in the critical regions A2, B1 and A1 of the cutter of Example 3 has been significantly reduced in tension. Moreover the hoop stress associated with critical region A1 has been rendered significantly compressive, resulting in the whole PCD table being in hoop compression.

Comparing the axial stress distribution of FIG. 16*a* to that of the reference FIG. 16*a*, it is seen that the tensile field at the circumferential free surface has been significantly reduced in extent as well as in being reduced in magnitude as shown in Table 3. With these results, it is expected that the propensity of crack initiation will be reduced and any cracks likely to initiate will be limited in extent.

Figure 18B:
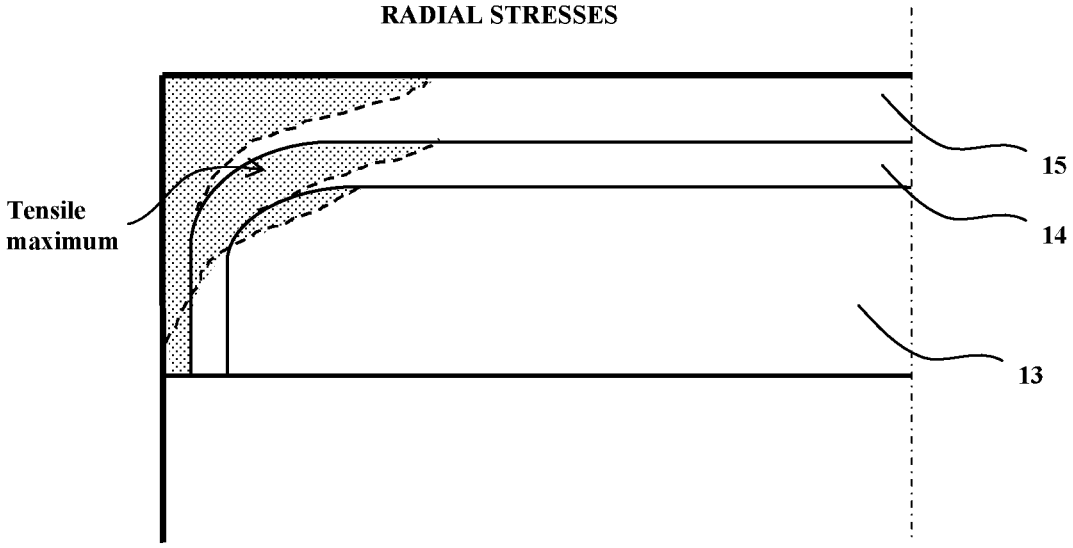

Comparing the radial stress distribution of FIG. 18*b* to that of the reference FIG. 16*b*, it is seen that the tensile maximum has been displaced away from the free surface of the PCD table and is situated in the intermediate material region 14. This position is well into the bulk volume of the PCD table and is now separated from the free surface by a field of compressive radial stress. It may thus be considered that the critical region B1 of FIG. 1 has been moved so that it is no longer bounded by the free surface of the PCD table and moreover is now separated from the free surface by a compressive barrier. This change of position of the critical region together with the significant reduction in radial tension is expected to result in propagating cracks being inhibited and prevented from propagating to the top free surface of the cutter.

Figure 18C:
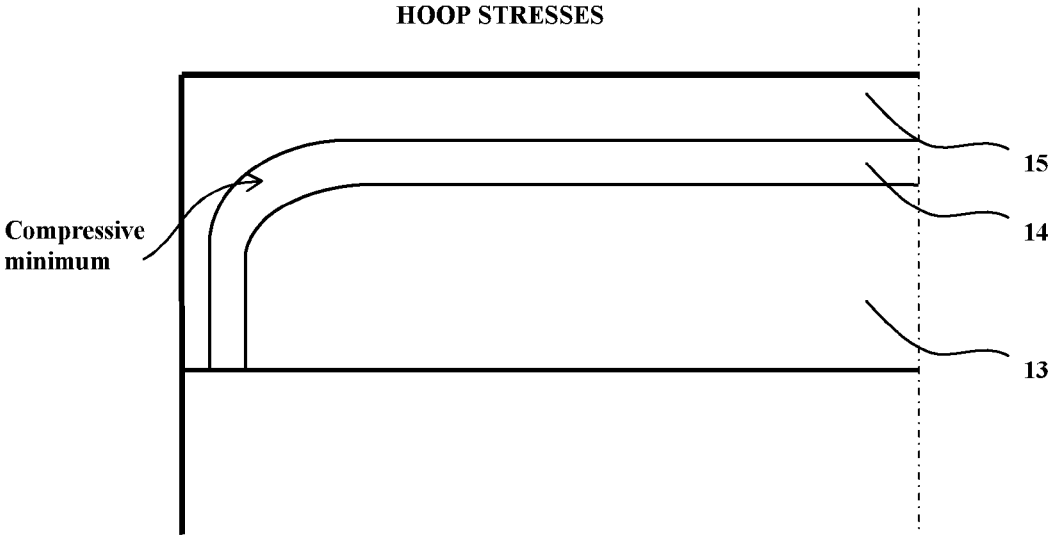

Comparing the hoop stress distribution of FIG. 18*c* to that of the reference FIG. 16*c*, it is seen that the tensile field has been completely eliminated so that the whole of the PCD table is in hoop compression. Moreover the tensile maximum position associated with critical region A1 of FIG. 1 now is replaced by a compressive minimum which has been moved so that it is no longer bounded by the free surface of the PCD table. This compressive minimum is now situated in the material of region 14.

It is expected that all these effects will combine so that any crack formation associated with the wear scar during rock cutting applications will be inhibited in propagation and prevented from extending to the free surface of the cutter and forming spallation of the PCD table.

Example 4

Figure 19:
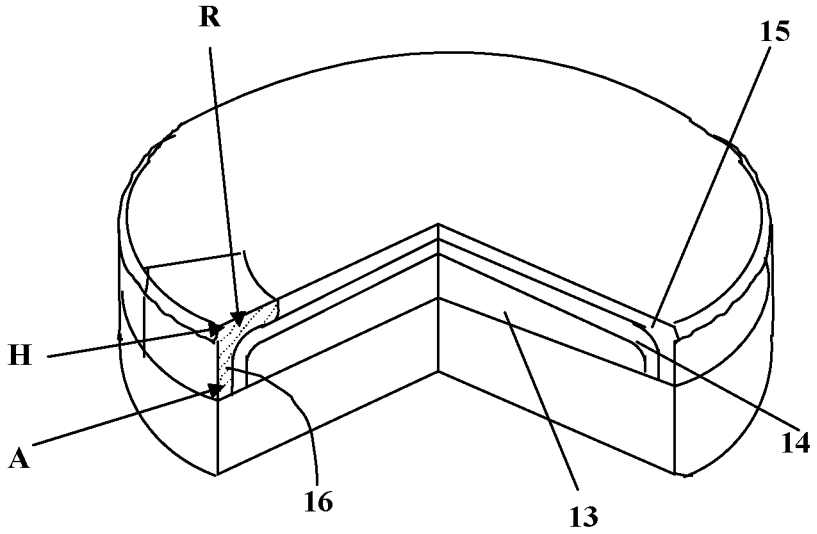
FIG. 19 is a three dimensional schematic diagram having a cutaway section of material at the top peripheral edge of a cutter, and adjoined and abutted by the embodiment of FIG. 18*a*.

PCD cutters were made according to FIG. 19 whereby a single 60° segment of PCD material was formed at the top peripheral edge of the cutter and was adjoined and abutted by the design of example 3, in the remaining 300° part of the cutter. FIG. 19 is a three dimensional schematic representation of this new design, with a cut away section, where a 60° peripheral segment of the outer volume of FIGS. 18*a,b,c*, labelled 15 was replaced by a material labelled as 16 in FIG. 19. This PCD material was known to have very good wear behaviour as determined from rock cutting tests. In the 300° remainder of the cutter, abutting the 60° segment, the design of FIG. 18 was used.

As in Examples 1, 2 and 3 the final PCD table thickness was 2.2 mm, bonded to a tungsten carbide, 13% weight cobalt hard metal substrate of 13.8 mm length. The right cylinder cutters were 16 mm in diameter and had a planar interface between the PCD table and the carbide substrate.

As in Examples 1, 2 and 3 tape casting techniques known in the art, were used to form so called green state discs, washers, and sectors of four appropriately chosen diamond powders bonded with water soluble organic binders. By assembling these discs, washers and sectors in a refractory metal container, the geometry of FIG. 19 was produced. A cylinder of tungsten carbide, 13% cobalt hard metal cylinder was then inserted into the refractory metal container to form and provide the substrate.

These assemblies were then vacuum degassed in a furnace at a temperature and time sufficient to drive off the binder materials, and subsequently subjected to a temperature of about 1460° C. at a pressure of about 5.6 GPa in a high pressure apparatus, as well established in the art.

With reference to FIG. 19, the three regions of differing PCD materials making up the 300° section abutting the 60° segment were made using exactly the same powders as in Example 3 and labelled 13, 14 and 15 in both FIGS. 18 and 19.

The 60° segment material labelled 16 in FIG. 19 was made from diamond powder of average particle size of about 13.0 microns with a multimodal size distribution extending from 2 microns to 30 microns. This diamond powder is known to form PCD material at the high pressure and temperature conditions used, with a cobalt content of about 8.8 volume percent, with a linear coefficient of thermal expansion of $3.95\times10^{-6}$/° C. and an elastic modulus of 1025 GPa. This particular material had been demonstrated to have very good low wear characteristics in rock cutting tests.

After removal from the high pressure apparatus, each cutter was brought to final size by grinding and polishing procedures known in the art. A sample of the cutters was cut and cross-sectioned and the dimensions of the volumes of different PCD materials measured and their volumes relative to the overall volume of the PCD table estimated. The boundary between the regions 13 and 14 was situated about 1.0 mm axially away from the substrate interface and about 0.5 mm from the circumferential free surface. The boundary between the regions 15 and 14 is situated about 0.6 mm away from the top free surface of the PCD table and about 0.25 mm from the circumferential free surface. The 60° segment extended about 2 mm in a radial direction from the circumferential free surface, was of thickness approximately 0.6 mm at the top free surface and approximately 0.25 at the circumferential free surface of the PCD table.

Regions 13, 14 and 15 were estimated to be approximately 38%, 23% and 44% of the overall volume of the PCD table respectively. The 60° segment, region 16 was estimated to occupy approximately 3% of the overall volume of the PCD table.

The cutters as manufactured with the resultant estimated volumes and dimensions and expected PCD material properties were modelled using Finite Element Analysis (FEA). As reference a planar cutter as in FIGS. 16*a, b, c* was considered, with material of the same properties as expected for the 60° segment, 16 in FIG. 19. As normal the essential properties of the stress distribution for such a planar cutter as shown in FIGS. 16*a, b*, and *c*. were obtained. The boundary conditions and type of mesh chosen for the calculation were constant for the reference and the design for the example so that the magnitudes of the stress maxima could be compared.

Table 4 gives the comparative FEA results where the stress maxima calculated in the 60° segment were compared to the corresponding stress maxima of the planar reference cutter where the PCD material is the same as material 16 of FIG. 19.

TABLE 4

| Stress Component | Reference single volume Planar Cutter Stress Maxima MPa | Example 4 cutters Stress Maxima in the 60° segment MPa | Comparison Normalised Reduction |
|---|---|---|---|
| Axial | 823 | 435 | 47% |
| Radial | 276 | 94 | 66% |
| Hoop | 52 | 25 | 52% |

The axial tensile stress maximum was situated at the circumferential PCD table free surface just above the substrate interface, as in the planar reference cutter and associated with the critical region A2 of FIG. 1, but at the 30° position in regard to the segment circumferential boundary, indicated by A in FIG. 19. This axial tensile maximum had been reduced by about 47% as compared to the planar reference cutter.

The radial tensile stress maximum in the segment was situated at the top free surface of the PCD table, as in the planar cutter reference and associated with the critical region B1 of FIG. 1, indicated by R in FIG. 19. This radial tensile maximum had been reduced by about 66% as compared to the planar reference cutter.

The hoop tensile stress maximum in the segment was situated at the top free surface of the PCD table, as in the planar cutter reference and associated with the critical region A1 of FIG. 1, indicated by H in FIG. 19. This hoop tensile maximum had been reduced by about 52% as compared to the planar reference cutter. Thus the cutter design of Example 3, used to adjoin and abut a segment of PCD material may induce significant reduction in the tensile stresses in the material of that segment. It was also found that the favourable stress distribution of Example 3 was largely also found in the abutting material of Example 4, with however some increase in tensile stress immediately adjacent to the 60° segment boundary.

It is expected that the tendency for crack propagation in the material of the segment will thus be reduced as compared to a planar cutter made from the same material, reducing in turn the spalling tendency, so that the good wear properties of the segment material may be exploited in rock cutting applications. Moreover the highly favourable stress distribution in the adjoining and abutting material with the design of Example 3 may also inhibit crack propagation, to inhibit cracks from reaching the PCD table free surfaces as in Example 3. This may also contribute to a reduction in spall occurrence.

These results indicated that cutter designs based upon some embodiments with favourable residual stress distributions may be used to adjoin and abut segments of PCD materials and may favourably reduce the tensile stresses in these segments as compared to situations where the segment material is used alone.

It is expected that similar results should occur when more than one segment is used.

The interfacial boundary between a PCD table and a carbide substrate attached thereto may be geometrically modified in order to alter the residual stress field in the PCD table. These modified interfaces are termed non planar interfaces and may have an influence on the general stress distributions in locations immediate to the interface. The general character of the critical regions described and indicated in FIG. 1 is not materially altered by adopting a non planar interface design but may be used in conjunction with some embodiments. An example is given in FIG. 12 which has the first to sixth regions 1 to 6 as shown in FIGS. 2*a* and 2*b*, but with a non-planar interface where the carbide substrate interface is generally convex with respect to the top surface of the PCD table.

Furthermore, modification of the geometry of the starting edge may be carried out by including, for example, a chamfer or the like, in order to reduce early chipping events. This practice may be used in conjunction with any or all of the embodiments.

Furthermore, treatments which remove in total or in part the metal component of PCD materials to a chosen depth from the free surface may be used to benefit the performance of PCD cutters. Typical depths exploited fall between 50 and 500 microns. The benefit is believed to reside primarily in improvements of thermal stability of the materials in the treated depth. However, an associated disadvantage of this treatment process is the occurrence of increased tensile stresses in the PCD materials adjacent to the treated layer or layers which may result in undesirable crack propagation. Embodiments may provide a means of mitigating this disadvantage by offsetting the tensile stresses by an already present induced compression brought about by placement of chosen materials. It is therefore possible to use such treatments in conjunction with one or more embodiments.

Also, certain heat treatments are able to partially anneal residual stresses and thereby reduce their magnitude. Typical of such treatments is to heat PCD cutters after removal from the high pressure apparatus under a vacuum at temperatures between 550° C. and 750° C. for time durations of a few hours. Such treatments are able to favourably alter the residual stress distributions but only to a limited degree. Heat treatments of this nature may be applied to the embodiments.

Although the foregoing description of superhard structures, production methods, and various applications of such structure and methods contain many specifics, these should not be construed as limiting the scope of the present invention, but merely as providing illustrations of some embodiments. Similarly, other embodiments may be devised which do not depart from the scope of the invention. For example, structures containing superhard and other materials arranged to have adjacent three dimensional zones, volumes or regions made from materials differing in properties and compositions as described may be fabricated using material assembly and preparation techniques such as tape casting, injection moulding, powder extrusion, inkjet printing, electrophoretic deposition and the like and any combination of such methods, all adapted to be capable of being applied to superhard material powders such as diamond and cBN. Also, whilst the embodiments described herein have made particular reference to polycrystalline diamond material, other superhard materials may be used. In addition, other hard materials, often containing diamond, may also be used to alter the stress distribution in the body of polycrystalline material by placement of these materials in appropriate regions.

The invention claimed is:

1. A superhard structure comprising:

a body of polycrystalline superhard material comprising:

a first region; and a second region, the second region being adjacent to an exposed surface of the superhard structure, the second region comprising a diamond material or cubic boron nitride, the density of the second region being greater than $3.4\times10^3$ kilograms per cubic meter when the second region comprises diamond material;

wherein the material or materials forming the first and second regions have a difference in coefficient of thermal expansion, the first and second regions being arranged such that the difference between the coefficients of thermal expansion induces compression in the second region adjacent the exposed surface; and wherein the first region or a further region has the highest coefficient of thermal expansion of the polycrystalline body and is separated in part from a peripheral free surface of the body of polycrystalline superhard material by the second region or one or more further regions formed of a material or materials of a lower coefficient of thermal expansion, wherein the regions comprise a plurality of grains of polycrystalline superhard material; and wherein the second region is peripherally discontinuous with a gap therein through which a portion of the region formed of the material of highest coefficient of thermal expansion extends to the free surface of the superhard structure.

2. A superhard structure as claimed in claim 1, wherein the body of polycrystalline superhard material comprises polycrystalline diamond material.

3. A superhard structure according to claim 1, further comprising a substrate bonded to a face of the body of polycrystalline material along an interface.

4. A superhard structure according to claim 3, further comprising a third region, a fourth region, a fifth region and a sixth region, the first to sixth regions being axisymmetric, the second to sixth regions being adjacent the first region and each second to sixth region having a lower coefficient of thermal expansion than the first region; wherein:

a) the first region is positioned between the second region and the substrate;

b) the third region being adjacent to the first region and at the interface of the substrate and the body of polycrystalline material, the third region being located at and forming a portion of the peripheral free surface of the body of polycrystalline material and between the first region and the substrate;

c) the fourth region being adjacent to the third region and situated at the peripheral free surface of the polycrystalline superhard material;

d) the fifth region being adjacent to the fourth region and the second region and separating the second region from the fourth region;

e) the sixth region being adjacent to the first region and separating the first region from the substrate.

5. A superhard material according to claim 4, wherein any one or more of the second, third, fourth, fifth or sixth regions is peripherally discontinuous with one or more gaps therein through which a portion of the region formed of the material of highest coefficient of thermal expansion extends to the free surface of the superhard structure.

6. A superhard structure according to claim 4, wherein the first and sixth regions are formed of the same material and have the highest coefficient of thermal expansion, the material from which the first and sixth regions are formed having a higher coefficient of thermal expansion than the material or materials from which the second, third, fourth, and fifth regions are formed.

7. A superhard structure according to claim 3, wherein the first region is formed of a material having the highest coefficient of thermal expansion of the materials in the superhard structure, the first region being situated substantially symmetrically around the central axis of the superhard structure at the interface of the body polycrystalline material and the substrate and separated from the free surfaces of the superhard material by the second region but extending through one or more gaps therein to a free surface of the superhard material, the second region being formed of a material having the lowest coefficient of thermal expansion in the superhard structure.

8. A superhard structure according to claim 7, wherein the first region is subdivided into more than one separate volume, all of the volumes being separated from the peripheral free surface of the superhard structure by at least one material of lower coefficient of thermal expansion.

9. A superhard structure according to claim 8 wherein one or more of the separate volumes are formed of a material having the highest coefficient of thermal expansion in the superhard structure and are toroidal.

10. A superhard structure according to claim 1, further comprising a third volume between the first and second regions, the third volume being formed of a material having a coefficient of thermal expansion different from that of the material from which the second region is formed.

11. A superhard structure according to claim 9, wherein one or more of the toroidal volumes formed of the material of highest coefficient of thermal expansion are segmented having one or more discontinuities.

12. A superhard structure according to claim 1, wherein the body of polycrystalline material is polycrystalline diamond material, and the region formed of the material having the highest coefficient of thermal expansion is formed from a polycrystalline diamond material having the highest metal content relative to the polycrystalline diamond material(s) in the other regions.

13. A superhard structure according to claim 1, wherein the body of polycrystalline material comprises a metal component, the metal component containing a second phase of a material which modifies the coefficient of thermal expansion of the polycrystalline material.

14. A superhard structure according to claim 1, wherein a portion or the whole of the free surface of the body of polycrystalline material comprises a layer in which metal content has been removed either in whole or in part.

* * * * *